US006943817B2

(12) United States Patent
Tanizaki et al.

(10) Patent No.: US 6,943,817 B2
(45) Date of Patent: Sep. 13, 2005

(54) COLOR IMAGE FORMATION APPARATUS

(75) Inventors: Junichi Tanizaki, Kasuya-gun (JP); Takuo Shimokawa, Chikugo (JP); Yoshitaka Kitaoka, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/868,088

(22) Filed: Jun. 15, 2004

(65) Prior Publication Data

US 2005/0001897 A1 Jan. 6, 2005

Related U.S. Application Data

(62) Division of application No. 10/256,721, filed on Sep. 27, 2002, now Pat. No. 6,785,492.

(30) Foreign Application Priority Data

Sep. 28, 2001 (JP) ..... 2001-301740
Sep. 28, 2001 (JP) ..... 2001-301746

(51) Int. Cl.[7] ..... B41J 27/00
(52) U.S. Cl. ..... 347/244; 347/258
(58) Field of Search ..... 347/241–244, 347/256–261, 115, 116, 135, 234; 359/204

(56) References Cited

U.S. PATENT DOCUMENTS 5,014,075 A * 5/1991 Okino ..... 347/232
5,300,962 A * 4/1994 Genovese ..... 347/135
5,508,785 A 4/1996 Takahashi et al. ..... 399/111
5,742,319 A 4/1998 Fukunaga et al. ..... 399/113
5,845,176 A 12/1998 Yoshida et al. ..... 399/113
6,346,957 B1 * 2/2002 Maruyama ..... 347/115
6,559,998 B2 * 5/2003 Yamakawa ..... 359/204
6,674,982 B2 1/2004 Saitoh et al. ..... 399/110

FOREIGN PATENT DOCUMENTS

JP 62-081650 4/1987
JP 7-028377 1/1995
JP 10020608 A * 1/1998 ..... G03G/15/01
JP 2001-209230 8/2001

* cited by examiner

*Primary Examiner*—Hai Pham
(74) *Attorney, Agent, or Firm*—Pearne & Gordon LLP

(57) ABSTRACT

An optical unit includes an incidence optical member for giving a different angle to each of a plurality of laser beams to form a color image and making the laser beam incident on a single polygon mirror rotation body; a single first reflecting mirror for reflecting the laser beam for each color reflected on the polygon mirror in the opposite direction to the incidence direction; and a single or plurality of second reflecting mirrors having Fθ characteristics for forming an image of each reflected laser beam reflected on the first reflecting mirror on the image formation position for each color.

10 Claims, 14 Drawing Sheets

COLOR IMAGE FORMATION APPARATUS

BACKGROUND OF THE INVENTION

This invention relates to improvement in an image formation apparatus, such as an electrophotographic printer or copier, particularly including a plurality of image formation units disposed along a transfer material transport passage for successively transferring toner images to a transfer material moving on the transfer material transport passage.

Known as a conventional image formation apparatus is an apparatus called tandem type including a plurality of image formation units disposed on a transfer material transport passage extending in a horizontal direction, for example, for successively transferring toner images from the image formation units to a transfer material moving along the transfer material transport passage and forming a color image on the transfer material.

The image formation unit refers to a pair of a photoconductor unit having a photoconductor on which an electrostatic latent image is formed and a developing unit for storing toner supplied to the photoconductor. Already proposed as the transport technique is a transfer roll transport technique wherein each image formation unit is provided with a transfer roll for abutting the photoconductor and paper as a transfer material is transported by the photoconductor and the transfer roll, or a belt transport technique wherein paper is, for example, electrostatically attracted and held on a circulating transport belt.

As for the arrangement structure of the image formation units, already proposed are a landscape orientation type wherein a plurality of image formation units are placed transversely side by side relative to a transfer material transport passage extending in the horizontal direction and a portrait orientation type wherein a plurality of image formation units are placed longitudinally relative to a transfer material transport passage extending in a vertical direction.

However, in this kind of the conventional landscape orientation type, often the image formation units are attached and detached from the direction parallel with the transport face of the transfer material transport member and vertical to the transport direction. In this case, the image formation units are positioned in the apparatus main unit by an image formation unit drive member attached to one side of the apparatus main unit and a positioning member formed on an opposite side of the apparatus main unit with the transport member between.

The image formation unit itself is positioned by a positioning section formed in a support member for supporting the photoconductor without directly positioning the photoconductor as the positioning reference on the configuration. Thus, it is difficult to ensure the positioning accuracy of each image formation unit in the apparatus main unit.

As for the conventional image formation apparatus of the portrait orientation type, each image formation unit can be attached and detached from the direction orthogonal to the transfer material transport passage of roughly vertical portion, so that each image formation unit can be positioned in the apparatus main unit by a unit positioning section formed on both sides of a cabinet and it becomes easy to ensure the positioning accuracy; in contrast, however, a disadvantage occurs in the transfer material transportability.

In the transfer roll transport technique, if the image formation unit spacing is wide to some extent, paper passes through the transfer part of one image formation unit, the pass-through paper portion becomes long, the tip state of the paper becomes easily unstable in such a manner that the tip of the paper curls or remains straight, and the tip position of the paper arriving at the transfer part of the next image formation unit easily varies.

Thus, the write start position of each color component toner image relative to the paper at the transfer part of each image formation unit shifts, causing a color shift or color unevenness phenomenon of a color image.

In the belt transport technique, paper is transported on the paper transport belt and thus the tip entry position of paper in the transfer part of each image formation unit is stable and the color unevenness of a color image relative to the paper transport direction can be suppressed as compared with the transfer roll transport technique. However, as the image formation unit spacing is wider, a walk phenomenon in which when the paper transport belt moves, it meanders in the width direction increases, and color shift or color unevenness of color image worsens in the orthogonal direction (width direction) to the paper transport direction.

SUMMARY OF THE INVENTION

It is therefore a first object of the invention to provide an image formation apparatus for enabling components to be well positioned in an apparatus main unit.

It is a second object of the invention to provide an image formation apparatus for making it possible to suppress a color shift and color unevenness of a color image accompanying transport unevenness of a transfer material and miniaturize the apparatus itself.

Although the solution means of the invention will be described to the specific contents to understand the invention, it is to be understood that the claims are not substantially reduced.

To accomplish the first object, the image formation apparatus of the invention includes the developing unit placed in the apparatus main unit displaceably or in a pressed state, the photoconductor unit placed in the apparatus main unit and is positioned, and the developing unit positioned relative to the positioned photoconductor unit.

To accomplish the second object, the image formation apparatus of the invention includes at least a part of the second photoconductor unit involving the second color positioned so as to overlap the first developing unit involving the first color, placed in the apparatus main unit in the move direction at the placing time.

A supplementary description to the invention to accomplish the second object is given below:

The inventor found out that it is important to miniaturize the apparatus to suppress a color shift and color unevenness of a color image accompanying transport unevenness of a transfer material and obtained the invention.

The process to obtain the invention will be discussed specifically.

Generally, as the color shift, color unevenness amount of color image not perceived as a problem by the user of an image formation apparatus, it is said that the maximum shift amount is 150 $\mu$m in the paper transport direction and is 100 $\mu$m in the orthogonal direction (width direction) to the paper transport direction.

By experiment concerning this point, we found out that the transfer part spacing of each image formation unit needs to be set to 30 mm or less to place within the above-mentioned shift amount.

By the way, in the conventional portrait orientation type, generally the limit of the spacing is 45 mm.

FIG. 15 is a schematic drawing of a conventional color image formation apparatus of the portrait orientation type. It is seen that the occupation space and attachment/detachment space of each image formation unit (205*a* to 205*d*) govern the image formation unit (205*a* to 205*d*) spacing.

As the configuration of the image formation unit (205*a* to 205*d*), the color image formation apparatus is placed in the normal orientation from the viewpoint of ensuring the space of a paper transport passage in the vertical direction and when FIG. 15 is viewed from the front of the plane of the Figure to the depth, a cleaning member 273*a*, a charging member 236*a,* and light exposure means 253*a* as image formation means are placed in the first quadrant with respect to a photoconductor 234*a,* a developing member is placed in the fourth quadrant, and space of the second and third quadrants is provided as much as possible.

Assuming that the diameter of the photoconductor 234*a* is a, that the height of a developing unit is b, and that the occupation height of the cleaning, charging member is c, the height of the image formation unit becomes about a+(b/2)+c.

If a=16 mm, b=20 mm, and c=10 mm as the minimum possible values of a, b, and c at present, the height of the image formation unit 205*a* becomes 36 mm. Allowing for a gap of 2 mm as an attachment/detachment margin of the adjacent image formation unit, it is considered that the limit of the transfer part spacing of each image formation unit (205*a* to 205*d*) is 38 mm.

That is, we found out that so long as the configuration of a simple extension of related arts continues to be adopted as mentioned above, if the components are miniaturized as much as possible, shortening the transfer part spacing involves a limit and the limit does not reach the level allowed by the user.

Thus, the inventor recognized the necessity for conceiving an epoch-making configuration and thought of the invention.

This means that we set the specific numeric target of 30 mm and examined the invention to shorten the image formation unit spacing from the viewpoints of miniaturization of the whole apparatus or ensuring the run stability of a transfer material transported in the vertical direction and the run stability of a transfer material transport belt.

That is, in a first aspect of the invention, as shown in FIG. 1, an image formation apparatus includes a photoconductor unit 8 (8*a* to 8*d*) having a photoconductor 34 on which an electrostatic latent image is formed and a developing unit 6 for storing toner supplied to the photoconductor, wherein the developing unit 6 is displaceably placed in an apparatus main unit and then the photoconductor unit 8 is detachably placed in the apparatus main unit and is positioned at a predetermined position, whereby the displaceable developing unit 6 previously placed is positioned relative to the photoconductor unit 8.

Such technical means is effective not only for a tandem image formation apparatus for forming a color image, but also for a single-color image formation apparatus on the configuration, of course.

Unit guide and positioning member and the unit shape may be selected appropriately and at least a photoconductor and a charging member may be built in the photoconductor unit and any other process means, such as a cleaning member or an electricity removal member, may be included as required, of course.

As for the developing method, an image support and various functional parts required for developing may be built in appropriately and various developing techniques may be adopted regardless of the developer type, contact developing or non-contact developing.

Developing unit guide part may be selected appropriately corresponding to the structure of the developing unit if the developing unit can be displaceably positioned in the same attitude for the corresponding guide part.

For example, if the developing unit guide part is provided with one displacement concave part, the developing unit may be provided with a positioning convex part fitted in a positioning-possible manner corresponding to the displacement concave part.

The unit positioning member of the photoconductor unit may be selected appropriately corresponding to the structure of the unit positioning member if it positions the photoconductor unit relative to the corresponding unit positioning part.

For example, if the unit positioning member is provided with a positioning concave part or a positioning pin, the photoconductor unit may be provided with a positioning convex part or a positioning groove fitted in a positioning-possible manner corresponding to the positioning concave part or the positioning pin.

To maintain good quality of an image developed on the photoconductor, the developing unit may be urged to the photoconductor unit side by a press member of a spring, etc., disposed in the apparatus main unit and a part of the developing unit may be abutted against the photoconductor of the photoconductor unit, whereby the developing unit may be positioned relative to the photoconductor unit.

Further, the guide and positioning member of the photoconductor unit and the developing unit is configured integrally, it is advantageous from the viewpoint of ensuring the attachment accuracy of the photoconductor and the developing roll. Particularly, preferably such a positioning structure minimizing an eccentric error of the photoconductor is adopted from the viewpoint of holding color registration good. It is desirable that the guide and positioning member of each unit should be attached to the apparatus main unit as an integrally configured member so that the pitch between the image transfer positions of each photoconductor unit becomes equal with high accuracy.

Further, the developing unit is displaceably placed at a predetermined position through a placement opening of the apparatus main unit and then the photoconductor unit is detachably placed in the apparatus main unit through the placement opening and at least a part of the photoconductor unit is positioned at a position overlapping the developing unit on the side near to the placement opening from the predetermined position and in the move direction to the placement opening, so that the height direction dimension of the image formation unit may be shortened as much as possible.

Further, another adjacent photoconductor unit is detachably placed in the apparatus main unit through the placement opening and at least a part of the photoconductor unit is positioned at a position overlapping the first developing unit on the side near to the placement opening from the predetermined position and in the move direction to the placement opening, whereby the image formation unit spacing can be more shortened.

When the image formation units are placed longitudinally, to take out the photoconductor unit and the developing unit of the same color, the adjacent photoconductor unit for a different color must first be taken out because of the positional relationship between the developing unit and the adjacent photoconductor unit for the different color overlapping each other.

However, in the recent tandem color image formation apparatus, as the developing technique of a developing unit, a dual-component developing technique is mainstream and it is expected that the developing unit itself will have a prolonged life. In this case, as the developing unit, importance is attached to the purpose of avoiding the risk of dropping the developing unit, mixing a foreign substance in the developing unit, etc., as the user removes the developing unit willfully.

Therefore, in such a form, a fixing member may be disposed so that the developing unit cannot easily attached to or detached from the apparatus main unit, and only the photoconductor unit may be able to be attached to and detached from the apparatus main unit.

Further, the transport and transfer member may be of any type if it transfers a toner image to a transfer material while giving a transport force to the transfer material; preferably a transfer roll a transfer roll to which a transfer electric field is applied is used from the viewpoint of a simple and small-sized device.

Further, if a transfer material is transported by the transport and transfer member, nothing may be provided before each image formation unit. However, preferably a transfer material guide for guiding a transfer material into the nip part between the photoconductor and the transport and transfer member is provided before each photoconductor unit from the viewpoint of more stably transporting the transfer material. However, the transfer material transport member and the transfer material guide need to become similar positional relationship to the corresponding photoconductor.

In such an aspect, the roughly vertical direction portion of a transfer material transport passage may have a plurality of transfer members and transfer material guides having the transfer material transport capability at the positions corresponding to the photoconductors of the photoconductor units, the plurality of transfer members may be positioned relative to the corresponding photoconductors through transfer member reception parts formed on both sides of the apparatus main unit, and the roughly vertical direction portion of the transfer material transport passage having the transfer member may be supported so that it can be opened and closed relative to the apparatus main unit.

In a second aspect of the invention, as shown in FIG. 9, if narrow pitch longitudinal placement of a plurality of image formation units is made possible, the maintenance space of each photoconductor unit becomes narrow and replacement becomes hard to perform.

In this case, an image formation apparatus comprises a plurality of developing units for storing different color toners to form a color image and a photoconductor unit group 50 for supporting on a single cabinet a plurality of photoconductors on which electrostatic latent images are formed, the electrostatic latent images being developed by the developing units, characterized in that the developing units are displaceably placed in an apparatus main unit and then the photoconductor unit group is detachably placed in the apparatus main unit and is positioned at a predetermined position, whereby the displaceable developing units previously placed are positioned relative to the photoconductors of the photoconductor unit group.

In such technical means, the unit guide and positioning member and the unit shape may be selected appropriately and at least as many photoconductors and a charging member as capable of forming a color image may be built in the photoconductor unit group and any other process means, such as a cleaning member or an electricity removal member, maybe contained as required, of course.

As for the developing method, various developing techniques may be adopted as described in the first aspect of the invention.

Further, the unit shape, the shape of the unit guide and positioning member, the developing unit positioning method relative to the photoconductors of the photoconductor unit group, and the like are similar to those previously described in the first aspect of the invention.

Next, the function and effect of the technical means as described above will be discussed. To begin with, in the configuration shown in FIG. 1, the integral-type image formation unit in the related art is divided into the photoconductor unit and the developing unit, so that the layout of the units is made flexible and it is made possible to place the image formation units with narrow pitches as compared with the integral-type image formation unit.

Further, the assembling accuracy of the photoconductor unit and the developing unit, which becomes disadvantageous as the integral-type image formation unit is divided, can be ensured by a single member of a pair of unit guide and positioning members of integral type attached to both sides of the apparatus main unit.

Further, the image formation apparatus has the advantage that the rotation center shaft of the photoconductor of the photoconductor unit can be directly positioned and supported.

It is also made possible to position the developing unit relative to the photoconductor.

Further, in the configuration shown in FIG. 9, a plurality of photoconductor units are put into one piece, whereby the positioning parts in the apparatus main unit can be reduced to a single part, so that parts management of the apparatus main unit is facilitated and it is made possible to improve the accuracy and simplify the apparatus configuration.

In a third aspect of the invention, as shown in FIG. 10, an optical unit includes an incidence optical member forgiving a different angle to each of a plurality of laser beams to form a color image and making the laser beam incident on a single polygon mirror rotation body (which will be hereinafter referred to as polygon mirror) rotating at high speed, a single image-forming lens having Fθ characteristic through which the laser beam for each color reflected on the polygon mirror passes through, a first reflecting mirror for reflecting the laser beam for each color after passing through the image-forming lens in the opposite direction to the incidence direction, and a plurality of second reflecting mirrors for forming an image of each reflected laser beam reflected on the first reflecting mirror on an image formation position for each color, so that the color laser beam spacing can be adjusted as desired in the optical unit (for example, by changing the installation angle of the second reflecting mirror or the like) and thus the image formation unit spacing can be shortened independently of placement of the optical unit. In such technical means, as the image formation unit, preferably the peripheral parts of an image support are put into a cartridge as much as possible considering the mount workability, etc., and use of a drum-like photoconductor as the image support is suited for short spacing.

Further, a transport and transfer member is any if it transfers a toner image to a transfer material while giving a transport force to the transfer material. Preferably, a transfer roll to which a transfer electric field is applied is used from the viewpoint of a simple and small-sized device. Further, if a transfer material is transported by the transport and transfer member, nothing may be provided before each image formation unit. However, preferably a transfer material guide for guiding a transfer material into the nip part between the image support of each image formation unit and the transport and transfer member is provided before each image formation unit from the viewpoint of more stably transporting the transfer material.

Ball bearings or plain bearings of resin material resistant to temperature change and abrasion support the outer peripheral surface of the image support for rotation, thereby suppressing run-out of each image support and a single endless belt is pressed against the outer peripheral surface of each image support and is frictionally driven, thereby setting the image supports to the same peripheral speed. Assuming that the transport speed of nip transport member of a pair of a registration roll and a pinch roll on the entrance side of the upstream image formation unit is V1, that the transport speed of fuser nip transport member on the exit side of the downstream image formation unit is V3, and that the peripheral speed of each image support is V2, the relation $V1 \geqq V2 \geqq V3$ is provided, whereby slack in a transfer material is produced on the nip upstream side of the upstream image support and transfer roll and on the fuser nip transport upstream side on the exit side of the downstream image support and transfer roll, and the effect of transport speed unevenness caused by nip transport on the entrance side and the exit side to the transfer material in the transfer part of the transfer roll and the image support can be ignored; it can be expected that a color shift and color unevenness of a color image accompanying transport unevenness of the transfer material can be suppressed.

The arrangement order of the image formation units may be set appropriately. Preferably, the downstream image formation unit forms a black toner image from the viewpoint of maintaining good image quality in a single-color black mode frequently used. The configuration in FIG. 13 is almost similar to that of the color image formation apparatus of the third aspect and therefore will not be discussed again. A transfer belt is selected as transfer material hold transport member. In the form, the apparatus itself is also upsized, the number of parts is also increased, and the cost is also increased as compared with the transfer roll transport member described above. However, as the transfer member, it is not indispensable to particularly give a transport force to a transfer material and thus the transfer member is not limited to transport and transfer member such as the transfer roll and may be a part such as a metal transfer roll of stainless steel, etc. Since it is not necessary to forcibly set the image supports to the same peripheral speed and the image formation unit spacing can shortened, it is made possible to reduce the peripheral length of the transport belt to a half or less as compared with that in the related art, a walk phenomenon in which when the paper transport belt moves, it meanders in the width direction can be suppressed, and color shift and color unevenness of the color image is improved in the orthogonal direction (width direction) to the paper transport direction.

In a fourth aspect of the invention, as shown in FIG. 14, an optical unit includes an incidence optical member for giving a different angle to each of a plurality of laser beams to form a color image and making the laser beam incident on a single polygon mirror, a single first reflecting mirror for reflecting the laser beam for each color reflected on the polygon mirror in the opposite direction to the incidence direction, and a single or a plurality of second reflecting mirrors having reflection and Fθ characteristics for forming an image of each reflected laser beam reflected on the first reflecting mirror on an image formation position for each color. Thus, similar advantages to those in the third aspect can be provided.

In a fifth aspect of the invention, as shown in FIGS. 10, 13, and 14, the reflection direction angle difference between the reflected laser beams each for each color reflected on the second reflecting mirror of the optical unit is set within 10 degrees, whereby the developing device configurations of the image formation units are made the same, it becomes easy to combine the developing characteristics of the image formation units, and there liability of the image quality is also enhanced.

DETAILED DESCRIPTION OF THE PREFERRED EMBODIMENT (Embodiment) 1

Referring now to the accompanying drawings, a first embodiment of the invention will be discussed.

Figure 1:
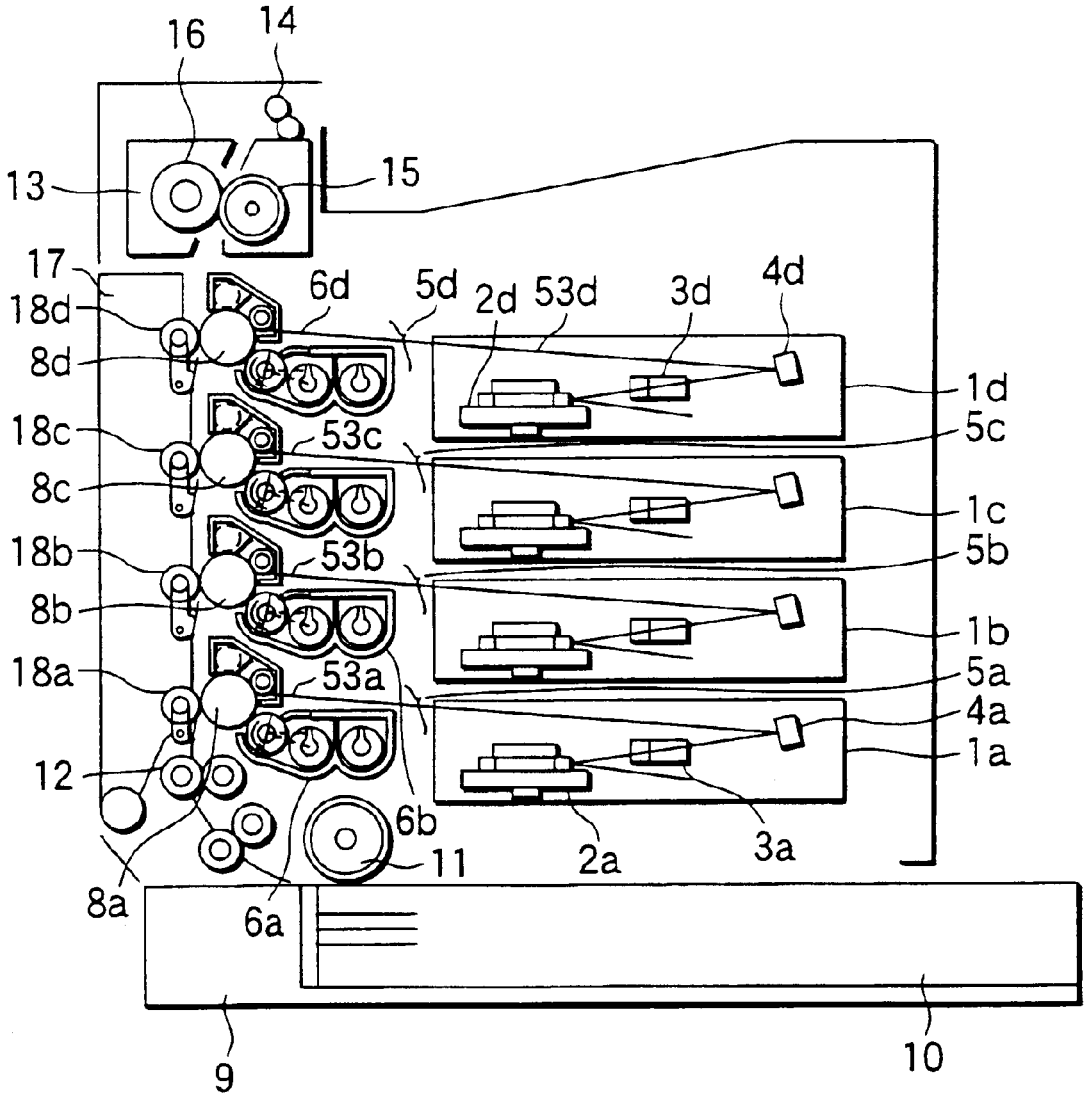
FIG. 1 is a schematic representation to show an outline of an image formation apparatus according to a first embodiment of the invention.

FIG. 1 shows an embodiment of a color image formation apparatus incorporating the invention. In the Figure, the color image formation apparatus includes image formation units (5*a* to 5*d*) of four colors (in the embodiment, yellow, magenta, cyan, and black) arranged in a longitudinal direction, a paper feed cassette 9 disposed below the image formation units for storing supplied paper 10, and a paper transport passage as a transport passage of paper 10 from the paper feed cassette 9, placed in a vertical direction at positions corresponding to the image formation units (5*a* to 5*d*).

In the embodiment, the image formation units (5*a* to 5*d*) and reflecting mirrors (4*a* to 4*d*) usually form yellow, magenta, cyan, and black toner images in order from the upstream side of the paper transport passage. The image formation apparatus includes the image formation units (5*a* to 5*d*) for forming color toner images on photoconductors 34 (see FIG. 4), for example, by electrophotography and transferring the toner images formed on the photoconductors 34 to paper (not shown) and optical units (1*a* to 1*d*) for applying laser beam to the photoconductors 34 for writing electrostatic latent images on to the photoconductors 34.

In the embodiment, the optical unit (1*a* to 1*d*) includes a semiconductor laser (not shown), a polygon mirror (2*a* to 2*d*), an image-forming lens (3*a* to 3*d*), and a reflecting mirror (4*a* to 4*d*) for deflecting and scanning light from the semiconductor laser (not shown) and introducing a light image (53*a* to 53*d*) through the image-forming lens (3*a* to 3*d*) and the reflecting mirror (4*a* to 4*d*) in to a light exposure point on the photoconductor 34.

Next, the image formation unit (5*a* to 5*d*) used in the embodiment will be discussed with FIG. 4. The image formation unit (5*a* to 5*d*) refers to a pair of a split photoconductor unit 8 (8*a* to 8*d*) and a developing unit 6 (6*a* to 6*d*).

Figure 4:
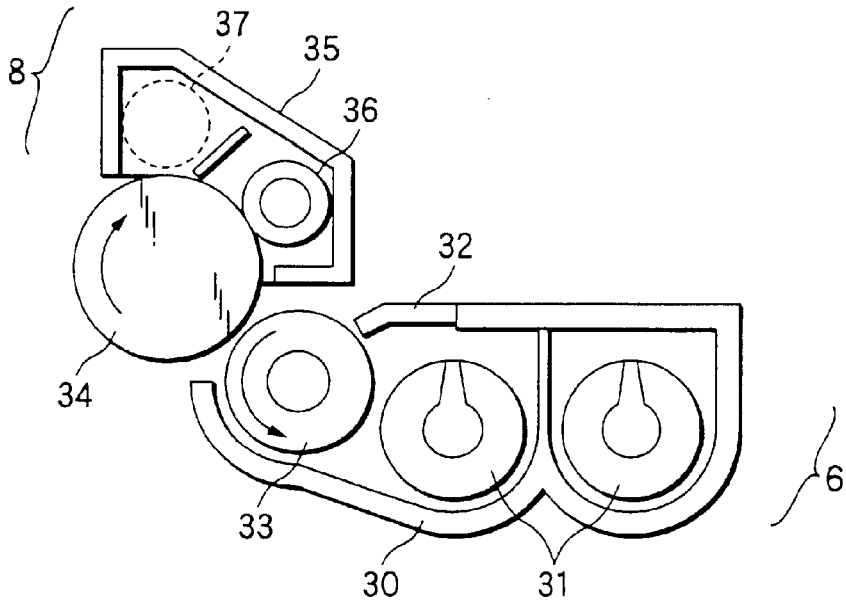
FIG. 4 is a schematic representation to show the configuration of an image formation unit used in the first embodiment of the invention.

The photoconductor unit 8 is a cartridge of a drum-like photoconductor 34, a charging roll 36 (36*a* to 36*b*) for previously charging the photoconductor 34, and a roller cleaner 37 made of an elastic substance sponge roll for removing the remaining toner on the photoconductor 34 in one piece as shown in FIG. 4. It is considered that the appropriate diameter of the photoconductor 34 is 30 mm to 16 mm from the viewpoints of shortening the image formation unit spacing, the paper transportability, and the transferability.

Further, in the paper transportability, it is understood that as the drum diameter is smaller, the pitch between the image formation units becomes narrower and transfer material separation in curvature separation from the photoconductor after transfer becomes stabler; this time, 16 mm is adopted as the diameter of the photoconductor 34.

On the other hand, the roller cleaner 37 is disposed above the photoconductor 34 and is shaped like a roller of conductive urethane foam. While the roller cleaner 37 is given a voltage of the opposite polarity to that of toner and has a peripheral speed difference from the photoconductor 34, the roller cleaner 37 rotates in contact with the photoconductor 34 in the same rotation direction as the photoconductor 34 for scraping the remaining toner off the photoconductor 34.

Figure 6A:
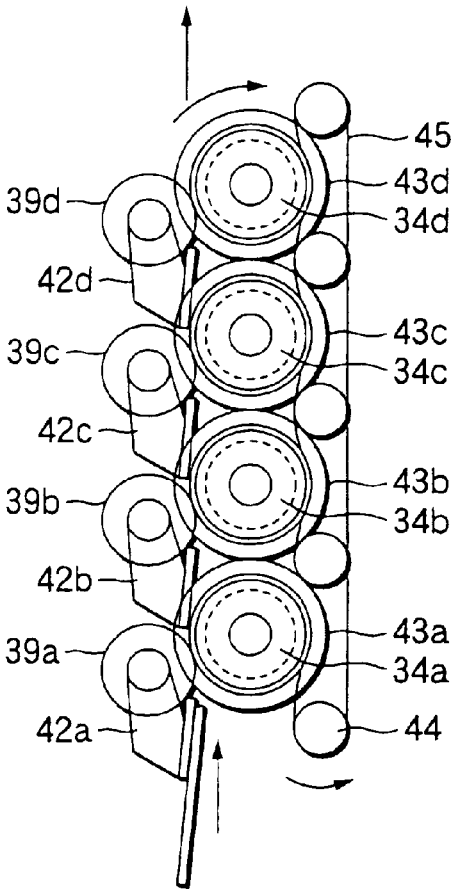
FIGS. 6A and 6B are schematic representations to show details of a paper transport system in the first embodiment of the invention.
Figure 6B:
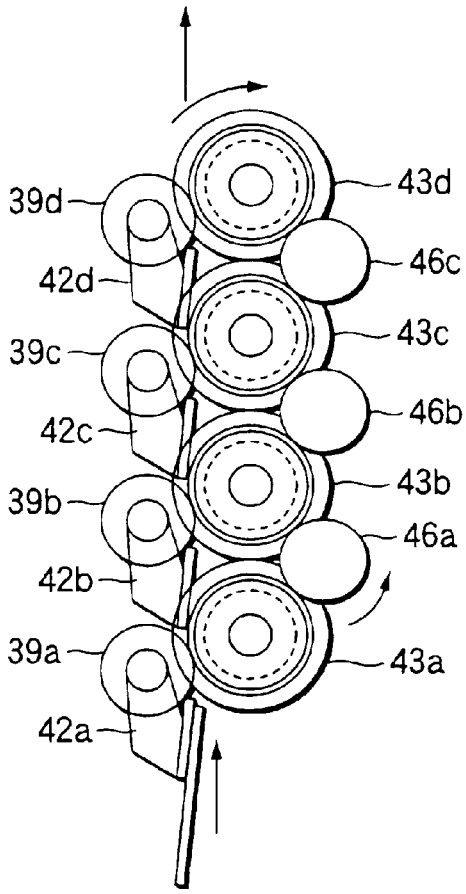

As shown in FIGS. 6A and 6B, to set the photoconductors 34 of the photoconductor units 8 (8*a* to 8*d*) to the same peripheral speed, ball bearings each with the outer periphery fixed and the inner periphery sliding or plain bearings (43*a* to 43*d*) made of resin material of PPS, etc., resistant to temperature change and abrasion support the outer peripheral surface of the photoconductor 34 for rotation, thereby suppressing run-out of each photoconductor 34 (34*a* to 34*d*) and the same face of a single endless belt 45 is pressed against the outer peripheral surface of a non-print area of each photoconductor 34 (34*a* to 34*d*) and the outer periphery of the photoconductor 34 is frictionally driven by a drive member 44 and drive transmission is performed by geared flanges (not shown) each attached to the end part of each photoconductor 34 (34*a* to 34*d*) and idle gears (46*a* to 46*c*), thereby setting the photoconductors 34*a* to 34*d* to the same peripheral speed.

The developing unit 6 (6*a* to 6*d*) in FIG. 4 has a developing case 30 for storing a developer containing predetermined color toner (not shown). Agitators 31 as a pair of developer agitating members are disposed in the developing case 30 and a developing roll 33 is disposed in an opening part of the developing case 30 opposed to the photoconductor 34 and a developer layer thickness regulating blade 32 for regulating the layer thickness of the developer on the developing roll 33 is provided.

A developing bias (not shown) is applied to the developing roll 33 and the developer (toner) on the developing roll 33 is jetted to the photoconductor 34.

Since a dual-component developing technique for making it possible to prolong the life of the developing unit 6 is adopted, a developer having toner and carrier is stored; on the configuration, a developing unit 6 of a mono component developing technique may be adopted for storing a mono component developer of a non-magnetic developer of a magnetic developer. The gap between the photoconductor 34 and the developing roll 33 is adjusted by cap rollers 27 (FIG. 5) coaxially with both end parts of the developing roll 33 and moreover rotatable as spacing setting members.

Particularly, in the embodiment, the developing case 30 for storing a developer is extended in the depth direction in FIG. 4, whereby the developer storage space is provided, so that the up and down direction dimension of each image formation unit is set short.

Figure 2:
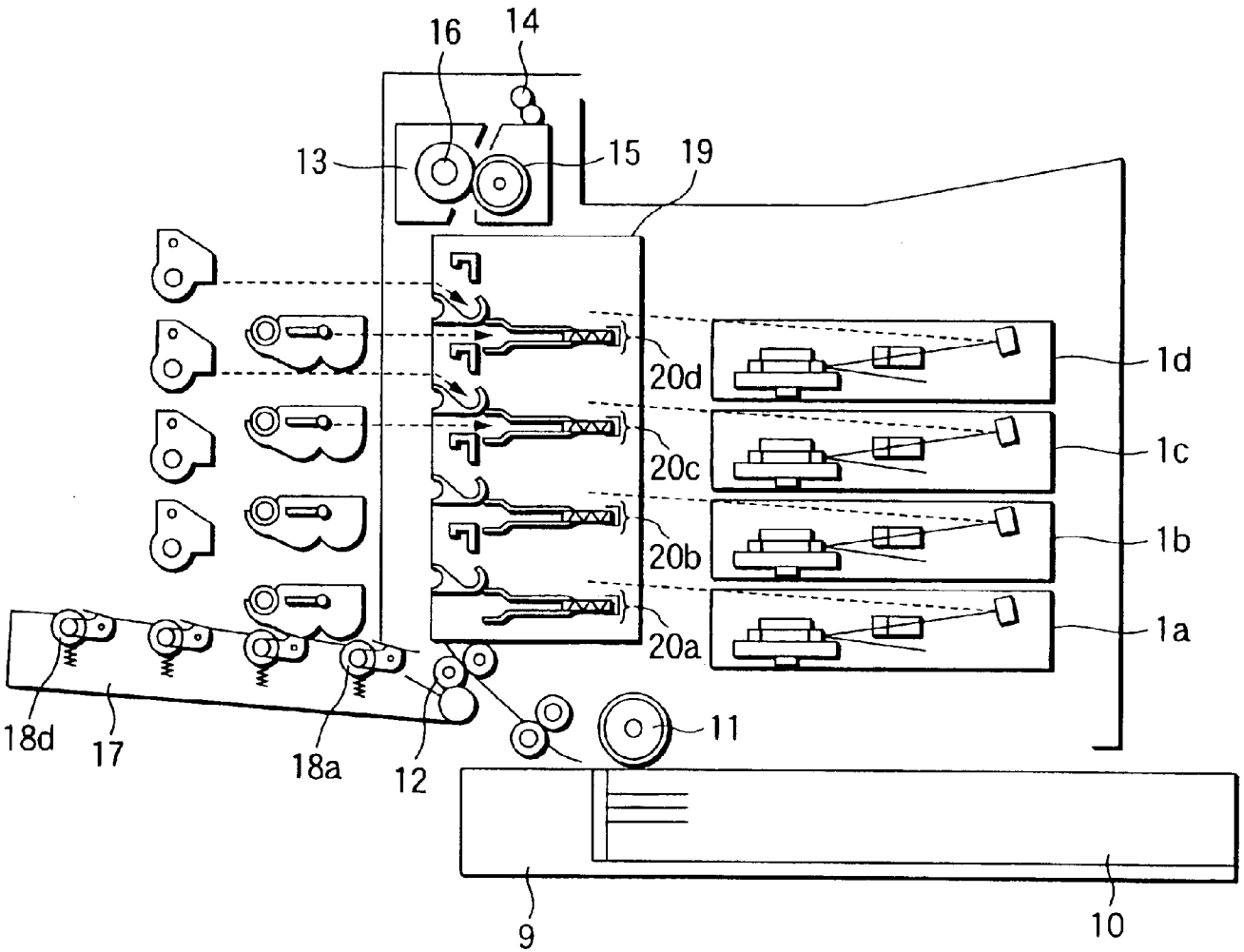
FIG. 2 is a schematic representation to show an outline of unit positioning used in the first embodiment of the invention.

In the embodiment, as shown in FIG. 2, a main unit housing has a door 17 on the left of the Figure (apparatus front or apparatus operation side), and each image formation unit 5 (5*a* to 5*d*) having the photoconductor unit 8 (8*a* to 8*d*) and the developing unit 6 (6*a* to 6*d*) can be taken in and out through a placement opening formed when the door 17 is opened.

Transfer members 18 (18*a* to 18*d*) for transferring toner images on the photoconductors (34*a* to 34*d*) to paper are attached to the door 17 and are pressed into contact with the photoconductors (34*a* to 34*d*) with the door 17 closed.

Figure 3A:
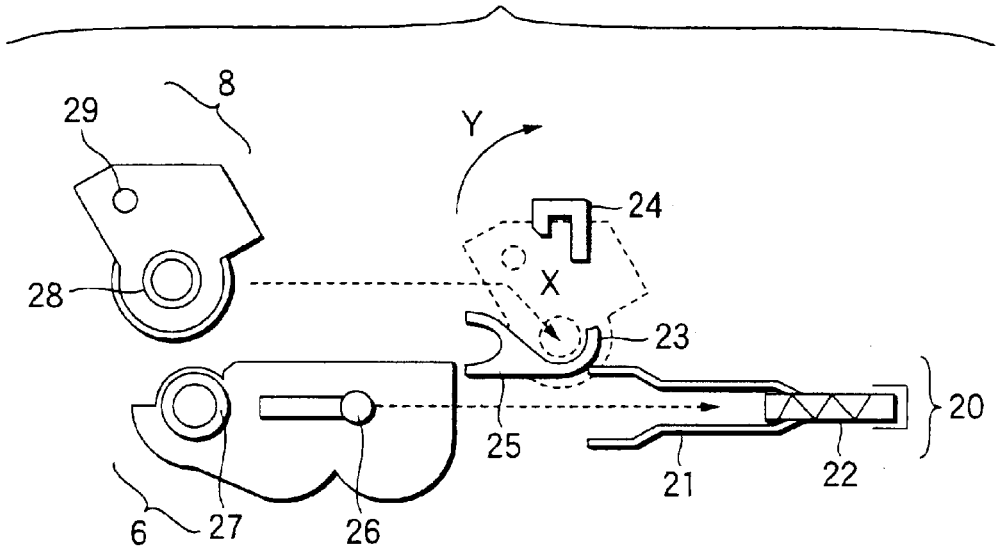
FIGS. 3A and 3B are schematic representations to show details of image formation unit positioning used in the first embodiment of the invention.
Figure 3B:
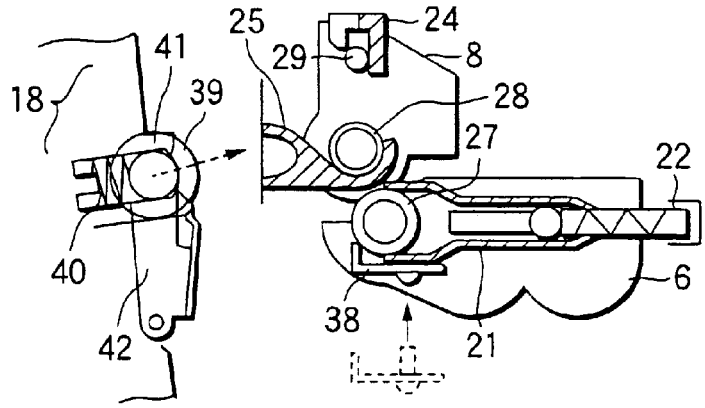

In the embodiment, the transfer member 18 shown in FIG. 3B adopts a rotatable transfer roll 39 coated with a foam conductive member. To attach the transfer roll 39, a transfer press spring 40 is provided so that both end parts of the transfer roll 39 are fitted into guide groove 41 formed in both sides of the door 17 and the transfer roll 39 is brought into contact with the photoconductor 34 by a predetermined press force from the rear, and the transfer roll 39 is abutted against the photoconductor (34*a* to 34*d*) by a transfer positioning member 25 formed in the main unit housing and is rotated in synchronization with the photoconductor (34*a* to 34*d*) through a drive transmission system (not shown).

A predetermined transfer electric field is applied to the transfer roll 39 forgiving a transfer force to the transfer roll side to the toner image on the photoconductor. Paper guides 42 for regulating the move path of paper are disposed before the photoconductors (34*a* to 34*d*). The paper guides (42*a* to 42*d*) are supported integrally on the transfer rolls (39*a* to 39*d*), are placed so that the paper entry angles and positions in the photoconductors (34*a* to 34*d*) conforming to transfer roll (39*a* to 39*d*) positioning become the same, and are adjusted so that they extend toward the direction in which the back of paper containing the tip of the paper transferred and transported always comes in contact with the faces of the paper guides (42*a* to 42*d*), that the paper moves toward the nip area between the photoconductor 34 and the transfer roll 39 while coming in contact with, and that the paper tip collides with the photoconductor 34 before the nip area.

In the embodiment, the main unit housing includes unit guide and positioning members 19 as guide and positioning members each having a plurality of common-shaped guide parts 20 (20*a* to 20*d*) for positioning the image formation units 5 (5*a* to 5*b*) and the transfer member 18 (18*a* to 18*d*). The unit guide and positioning members 19 are disposed in a pair on the inner faces of the front and rear plates of the main unit housing.

The unit guide and positioning members 19 will be discussed with reference to FIGS. 3A and 3B. Numeral 21 denotes a developing unit positioning guide part as a guide part. It has a guide groove in a roughly horizontal direction and is shaped like the groove width on the door side widened one step. Developing unit press spring member 22 (press member) is attached to the narrow depth part of the guide part on the opposite side to the door.

Numeral 23 denotes a photoconductor center bearing part (positioning part) for positioning the photoconductor unit. It is adjacent to the developing unit positioning guide part 21 at a roughly opposed position (describe later in detail), forms roughly the U-shape for supporting a rotation center shaft 28 of the photoconductor 34 at a predetermined position, and has an inclination angle of about 30 to 45 degrees in the direction of the door 17. A photoconductor unit whirl stop part 24 having an elastic hook part roughly horseshoe-shaped is formed roughly above the photoconductor center bearing part 23. A transfer roll positioning guide 25 (transfer member positioning part) roughly U-shaped is formed on the door side integrally with the photoconductor unit positioning part 23.

Figure 5:
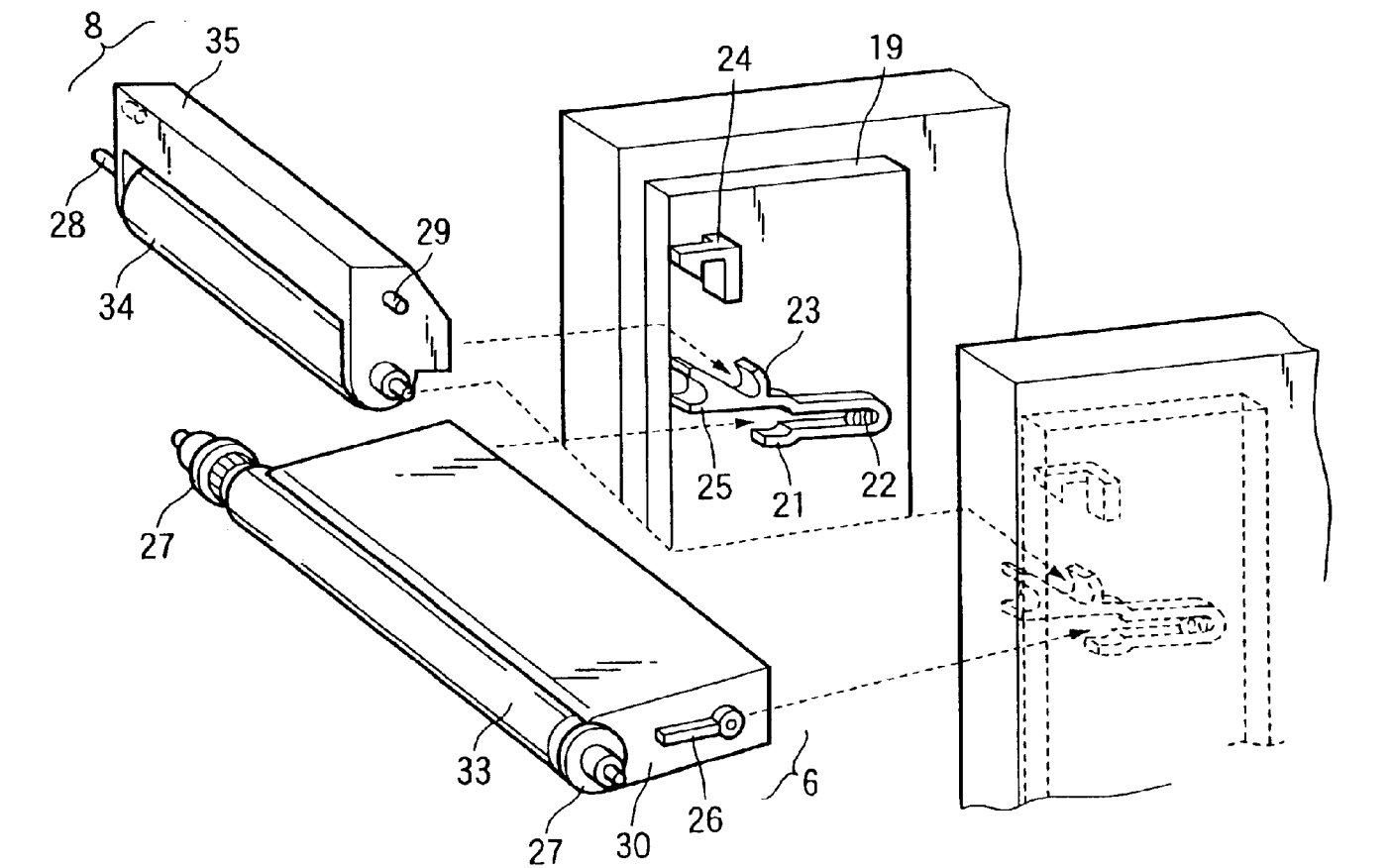
FIG. 5 is a perspective detailed view of image formation unit positioning used in the first embodiment of the invention.

In the embodiment, to place the developing unit 6 in the unit guide and positioning members 19, as shown in FIG. 5, guide protrusion strips 26 formed on both ends of the developing unit 6 are inserted into large-diameter grooves of the developing unit positioning guide parts 21 and from this state, the developing unit 6 is pushed into small-diameter groove depth sides, and the tips of the cap rollers 27 coaxially with both end parts of the developing roll 33 of the developing unit 6 and moreover rotatable are fitted into the large-diameter groove positions of the developing unit positioning guide parts 21. This process is performed for all developing units.

To narrow the spacing between the image formation units 5 (5*a* to 5*d*) as much as possible, each photoconductor unit 8 (8*a* to 8*d*) is placed detachably in the apparatus main unit through the placement opening and at least a part of the photoconductor unit 8 is positioned at a position overlapping the developing unit 6 on the side near to the placement opening from the predetermined position and in the move direction to the placement opening.

That is, the unit guide and positioning members 19 have the guide parts so that each developing unit 6 (6*a* to 6*d*) is positioned at a position overlapping at least either of the adjacent photoconductor units 8 relative to the displacement direction of the developing unit 6.

Further, as shown in FIG. 3B, a developing unit fixing member 38 shaped roughly like the letter L is fixed to the developing unit positioning guide part 21 with a screw, etc., from below, whereby it can also be made hard to remove the developing unit 6 (6*a* to 6*d*).

Next, in order to place each photoconductor unit 8 (8*a* to 8*d*), as shown in FIG. 3A, the photoconductor unit 8 is moved in the arrow X direction with the photoconductor unit 8 tilt and is attached to the photoconductor unit positioning part 23. At this time, both end parts of the photoconductor rotation center shaft 28 (28*a* to 28*d*) projected from both end parts of the photoconductor unit 8 in the axial direction thereof are put on a door side inclination part of the photoconductor unit positioning part 23 and are pushed into the end and the photoconductor unit 8 is rotated in the arrow Y direction, whereby a whirl stop pin 29 formed on a side of a photoconductor unit case 35 is fitted into the photoconductor unit whirl stop part 24 and the photoconductor unit 8 is positioned, as shown in FIG. 3B.

At this time, the already positioned developing unit 6 stops in a free state in which it does not receive the press force of the developing unit press spring member 22. However, as shown in FIG. 3A, if the photoconductor unit 8 is moved in the arrow X direction with the photoconductor unit 8 tilt, the cap rollers 27 (FIG. 5) at both ends of the developing unit 6 abut both end parts of the photoconductor 34 of the photoconductor unit 8 (parts not contributing to image formation) Further, as the photoconductor unit 8 is inserted into the photoconductor unit positioning part 23, the cap rollers 27 of the developing unit 6 are pushed by the photoconductor unit 8 and the developing unit 6 is also moved in a direction urging the developing unit press spring member 22. When the photoconductor unit 8 is attached to the photoconductor unit positioning part 23, the developing unit 6 receives press forces from both of the photoconductor unit 8 and the developing unit press spring member 22 and stops and is positioned.

In FIG. 5, the cap rollers 27 are placed coaxially with both ends of the developing roll 33 and the radius of the cap roller can also be designed a little larger than the radius of the developing roll 33. In this case, the cap rollers 27 abut the photoconductor 34 in the above-described positioning state and thus the developing roll 33 and the photoconductor 34 are positioned with a slight gap maintained.

It is desirable that the urging force of the developing unit press spring member 22 should be twice or more the reaction force produced by driving the developing roll. Likewise, the transfer member is also positioned at the transfer roll positioning guide 25 roughly U-shaped as the door is closed.

In the embodiment, as shown in FIG. 1, the paper feed cassette 9 is provided with a feed roll 11 for sending paper 10 at a predetermined timing and a pair 12 of a registration roll and a pinch roll as a nip transport member on the entrance side is placed on the paper transport passage positioned between the feed roll 11 and the transfer part of the upstream image formation unit 5*a* and an optical paper passage sensor (not shown) is disposed downstream of the paper transport passage 34. In the embodiment, the paper passage sensor (not shown) detects the tip of paper and, for example, the electrostatic latent image write timing in the optical unit 1 (1*a* to 1*d*) of each image formation unit 5 (5*a* to 5*d*) is controlled based on the detection timing of the paper tip.

A fuser 13 as a nip transport member on the exit side is placed on the paper transport passage positioned downstream from the downstream image formation unit 5*d*. The fuser 13 having a heating roll 15 and a pressurizing roll 16.

An ejection roll 14 for ejecting paper is placed downstream from the fuser 13 and ejected paper is stored in a storage tray formed on the top of housing.

Assuming that the transport speed of the registration roll and pinch roll pair 12 forming the nip transport member on the entrance side is V1, that the transport speed of the paper ejection roll 14 and the heating roll 15 of the fuser 13 forming the nip transport member on the exit side is V3, and that the peripheral speed of each photoconductor (34*a* to 34*d*) is V2, the relation $V1 \geqq V2 \geqq V3$ is provided, whereby slack in paper is produced on the nip upstream side of each photoconductor (34*a* to 34*d*) and each transfer roll (39*a* to 39*d*) and on the fuser nip transport upstream side on the exit side, and the effect of transport unevenness caused by nip transport on the entrance side and the exit side to paper in the transfer part of the transfer roll 39 and the photoconductor 34 can be ignored.

Next, the operation of the color image formation apparatus according to the embodiment will be discussed with FIG. 1.

Paper 10 in the paper feed cassette 9 is delivered by the feed roll 11 in response to an output signal from a personal computer, etc., (not shown) and then the tip of the paper arrives at the nip part of the registration roll and pinch roll pair 12 on the entrance side. Then, the paper 10 is nipped and transported in the registration roll and pinch roll pair 12 on the entrance side and enters the transfer parts of the image formation units (5*a* to 5*d*) on the paper transport passage in order.

At this time, as for the paper transport speed, the nip transport speed V1 of the registration roll and pinch roll pair 12 on the entrance side and the photoconductor (34*a* to 34*d*) speed V2 involve the relation $V1 \geqq V2$ and thus slack in the paper is produced between the upstream image formation unit 5*a* and the registration roll and pinch roll pair 12 on the entrance side. Thus, the effect of the transport force of the nip transport part of the registration roll and pinch roll pair 12 on the entrance side can be ignored on the paper entering the transfer part of the upstream image formation unit 5*a* and the transfer roll 39*a*.

Further, the passage speed of the paper in the transfer part of each image formation unit (5*a* to 5*d*) is held constant according to the configuration described above. Moreover, the transfer part spacing of each image formation unit (5*a* to 5*d*) is set sufficiently short relative to the paper length (about 30 mm) and thus the tip proximity of the paper entering the transfer part of each image formation unit (5*a* to 5*d*) is held in the registration roll and pinch roll pair 12 on the entrance side or the transfer nip part (nip part between the photoconductor and the transfer roll) of the image formation units (5*a* to 5*d*) on the front side. Because of the free end length for allowing sufficient firmness of even thin paper to be expected, the tip position of the paper entering the transfer part of each image formation unit (5*a* to 5*d*) becomes stable.

Thus, the paper entry timing in the transfer part of each image formation unit (5*a* to 5*d*) is held constant, so that the transfer position shift of each color toner image is eliminated and color shift and color unevenness of the color image are eliminated.

Because of the relation $V2 \geqq V3$ where V3 is the transport speed when the tip of the paper arrives at the fuser 13 and is nipped between the paper ejection roll 14 and the heating roll 15 as fuser nip transport and V2 is the peripheral speed of each photoconductor (34*a* to 34*d*), slack is produced in the paper between the fuser 13 and the last image formation unit 5*d*, and the paper transport force of the fuser nip transport member has no effect on the paper in the transfer nip part of each image formation unit (5*a* to 5*d*). Thus, the passage speed of the paper in the transfer part of each image formation unit (5*a* to 5*d*) is always held constant.

After this, when the paper has passed through the fuser 13, the paper on which a toner image is fixed is ejected through the paper ejection roll 14 to the storage tray. In such an operation process, it was recognized that a color image with no color shift, no color unevenness is provided.

Particularly, in the embodiment, the paper transport passage is placed vertically and the image formation units (5*a* to 5*d*) are arranged longitudinally, so that the up and down direction dimension of the housing is set short and moreover the paper feed cassette 9 is disposed below the image formation units (5*a* to 5*d*) and thus the need for providing the installation space as the paper feed cassette 9 protrudes to the outside is eliminated, so that the apparatus can be easily compacted.

It is made possible to position each image formation unit (5*a* to 5*d*) by a single member of a pair of unit positioning members 19 attached to both sides of the apparatus main unit, so that it becomes easy to ensure the accuracy. Further, the image formation apparatus has the advantage that the rotation center shaft 28 of the photoconductor of the photoconductor unit 6 can be directly positioned and supported.

Since the image formation unit spacing can be shortened to 25 mm, the paper transport stability can be provided without using an expensive member such as a paper transport belt member, and it is made possible to provide a color image with no color shift and no color unevenness.

Figure 7:
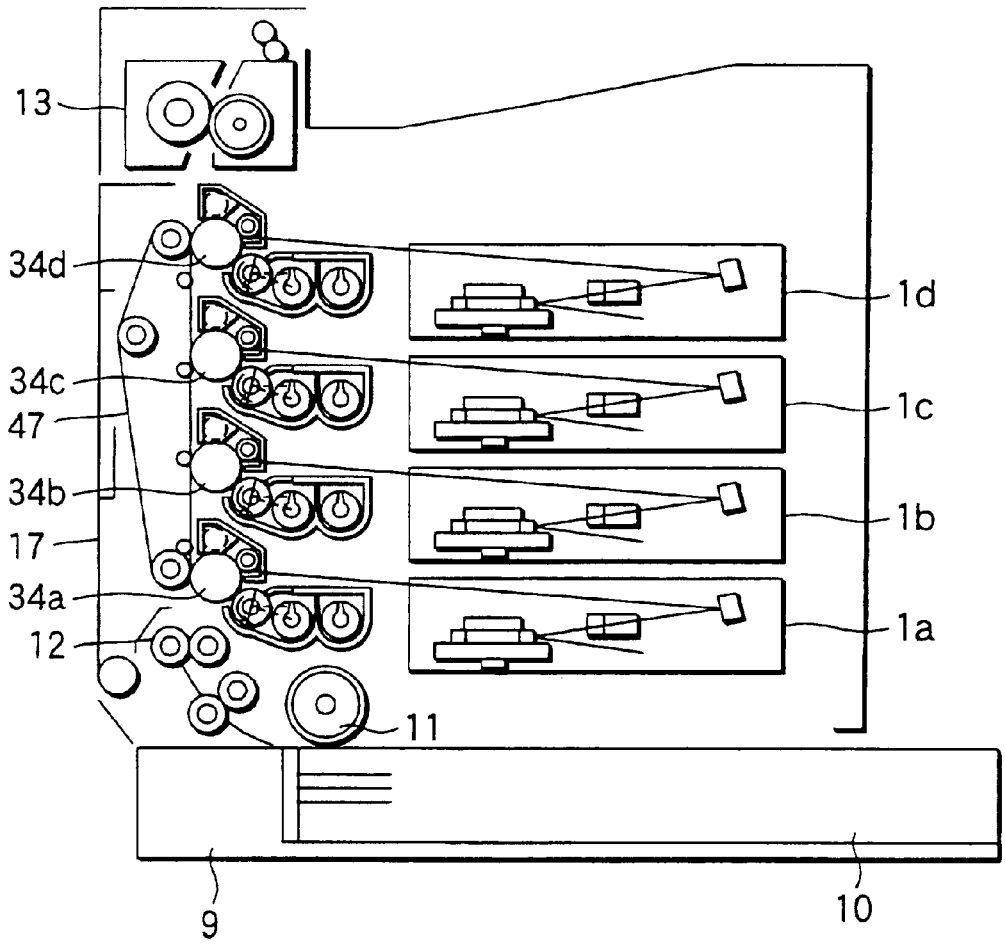
FIG. 7 is a schematic representation to show a different form of the image formation apparatus according to the first embodiment of the invention.

As shown in FIG. 7, the transfer material hold transport member is not limited to the transfer roll and may be a transport belt 47. In this case, as the transfer member, it is not indispensable to particularly give a transport force to a transfer material and thus the transfer member is not limited to transport transfer member such as the transfer roll and may be a part such as a metal transfer roll of stainless steel, etc.

Since it is not necessary to forcibly set the photoconductors (34 *a* to 34*d*) to the same speed, it is not necessary either to perform frictional drive with a bearing and an endless belt for supporting the outer periphery of the photoconductor, but the parts placement space of the transfer parts and the tension roller space of the transport belt become necessary and the up and down dimension of the apparatus becomes large as compared with the transfer roll transport technique.

However, the image formation unit (5*a* to 5*d*) spacing can be shortened, so that it is made possible to reduce the peripheral length of the transport belt to a half or less as compared with that in the related art, a walk phenomenon in which when the paper transport belt moves, it meanders in the width direction can be suppressed, and color shift and color unevenness of the color image can be improved in the orthogonal direction (width direction) to the paper transport direction.

(Embodiment) 2

Figure 8:
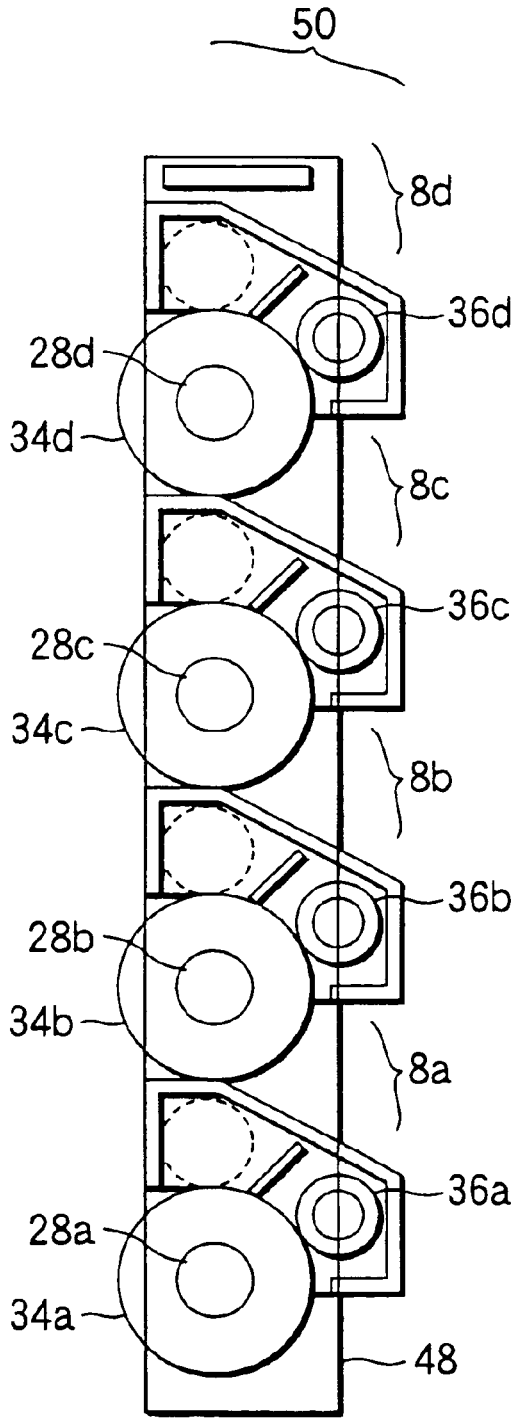
FIG. 8 is a schematic representation to show a photoconductor unit group used in a second embodiment of the invention.

A second embodiment of an image formation apparatus incorporating the invention will be discussed with reference to FIGS. 8 and 9.

Components in the second embodiment similar to those in the first embodiment will not be discussed again in detail. In FIG. 8, a plurality of photoconductor units 8 (8*a* to 8*d*) are fixed to and supported on a cabinet 48 using metal sheets each shaped roughly like angular U in combination with screws, etc. A center shaft 28*a* of a photoconductor 34*a* positioned upstream in the paper transport direction is used as the positioning reference of an integral photoconductor unit group 50 and a center shaft 28*d* of a photoconductor 34*d* positioned downstream is fitted into an abutment part 54 (described later), whereby it is made to function as a whirl stop pin (shaft).

The shapes of a unit guide and positioning member, a developing unit, and a transfer member in a main unit housing are similar to those of the first embodiment except for the portion of the integral photoconductor unit group 50 and therefore only the positioning portion of the integral photoconductor unit group 50 will be discussed.

Figure 9:
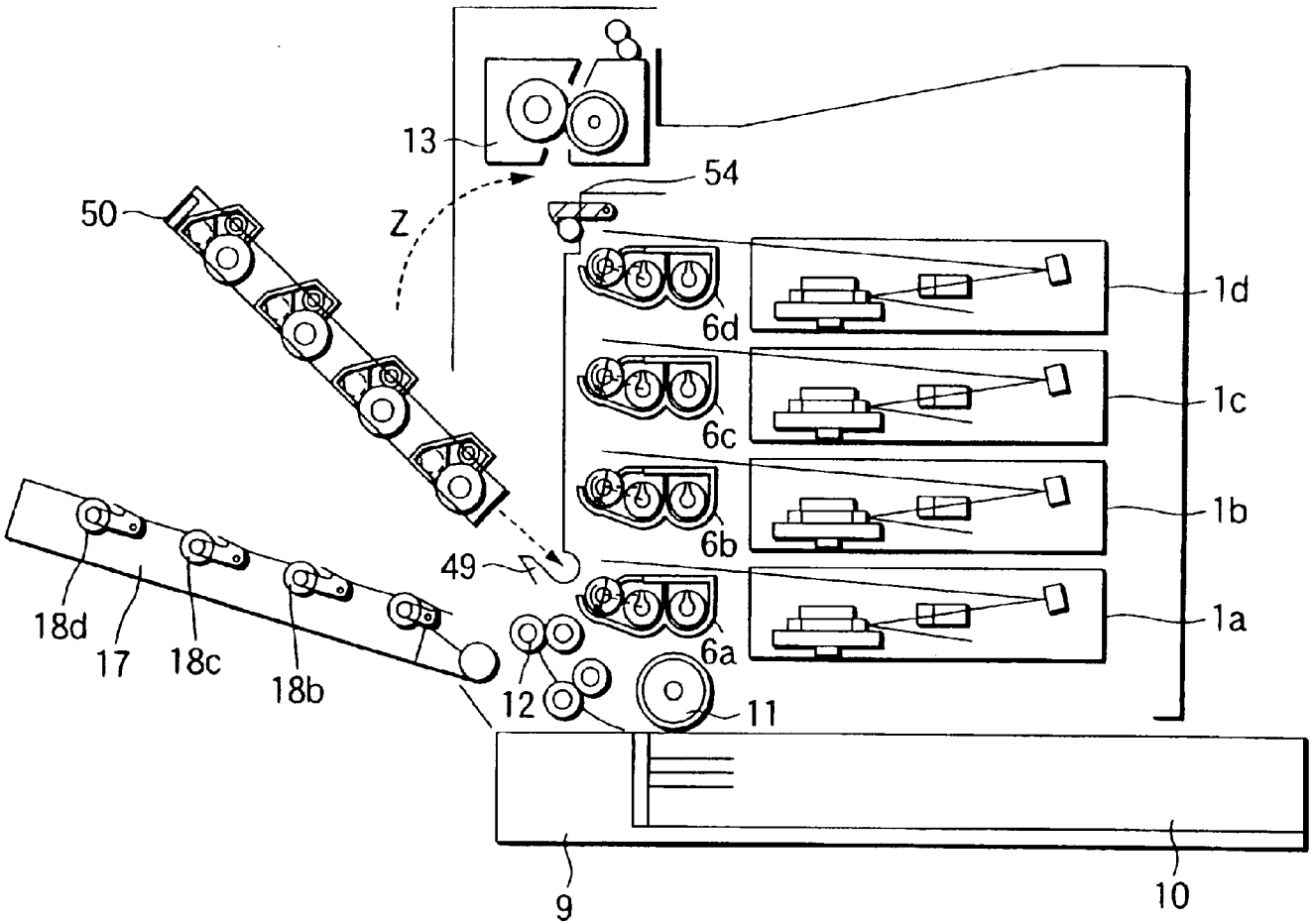
FIG. 9 is a schematic representation to show details of image formation unit positioning used in the second embodiment of the invention.

As shown in FIG. 9, in the apparatus, a guide part 49 shaped roughly like the letter U is formed at a predetermined position corresponding to the center shaft 28*a* of the photoconductor 34*a* positioned upstream in the paper transport direction, and the whirl stop abutment part 54 shaped roughly like the letter L is formed at a predetermined position corresponding to the center shaft 28*d* of the photoconductor 34*d* positioned downstream.

The integral photoconductor unit group 50 is a little tilt to the side of a door, the upstream photoconductor center shaft 28*a* is pushed into the guide part 49 shaped roughly like the letter U and is rotated in the arrow Z direction, and the center shaft 28*d* of the photoconductor 34*d* is fitted into the abutment part 54, whereby the integral photoconductor unit group 50 is positioned in the apparatus. The operation is similar to that described above and therefore will not be discussed again.

(Embodiment) 3

Figure 10:
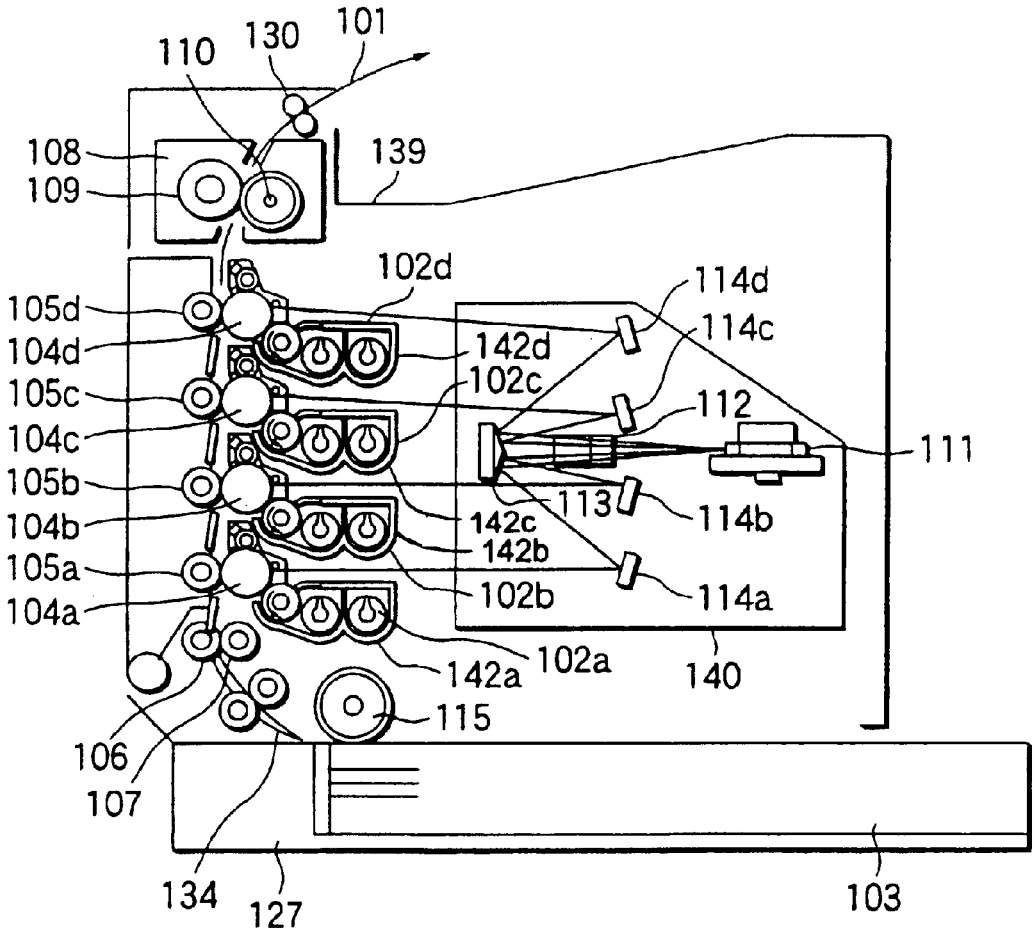
FIG. 10 is a schematic representation to show an outline of an image formation apparatus according to a third embodiment of the invention.

FIG. 10 shows a third embodiment of a color image formation apparatus incorporating the invention. In the Figure, the color image formation apparatus includes image formation units (102*a* to 102*d*) of four colors (in the embodiment, yellow, magenta, cyan, and black) arranged in a longitudinal direction, a paper feed cassette 127 disposed below the image formation units for storing supplied paper 103, and a paper transport passage 134 as a transport passage of paper from the paper feed cassette 127, placed in a vertical direction at positions corresponding to the image formation units (102*a* to 102*d*).

In the embodiment, an optical unit 140 includes an incidence optical unit (not shown) having a cabinet for holding color semiconductor lasers integrally and optical elements forgiving a different angle to each color laser beam and making the color laser beam incident on a single polygon mirror surface rotating at high speed, a single image-forming lens 112 having Fθ characteristic through which each color laser beam reflected on a polygon mirror 111 passes through, a first reflecting mirror 113 for reflecting the laser beam after passing through the image-forming lens 112 in the opposite direction to the incidence direction, and a plurality of second reflecting mirrors (114*a* to 114*d*) for forming an image of each laser beam reflected on the first reflecting mirror 113 on the image formation position for each color. According to the configuration, the image formation position spacing for each color can be adjusted as desired by changing the installation angles of the image-forming lens 112 and the reflecting mirrors (113, 114*a* to 114*d*). It is understood from optical design that the appropriate image formation position spacing for each color is 25 mm to 35 mm from the viewpoints of ensuring accuracy on working on the image-forming lens 112 and the reflecting mirrors (113, 114*a* to 114*d*) and ensuring the reliability of the characteristics.

Figure 12:
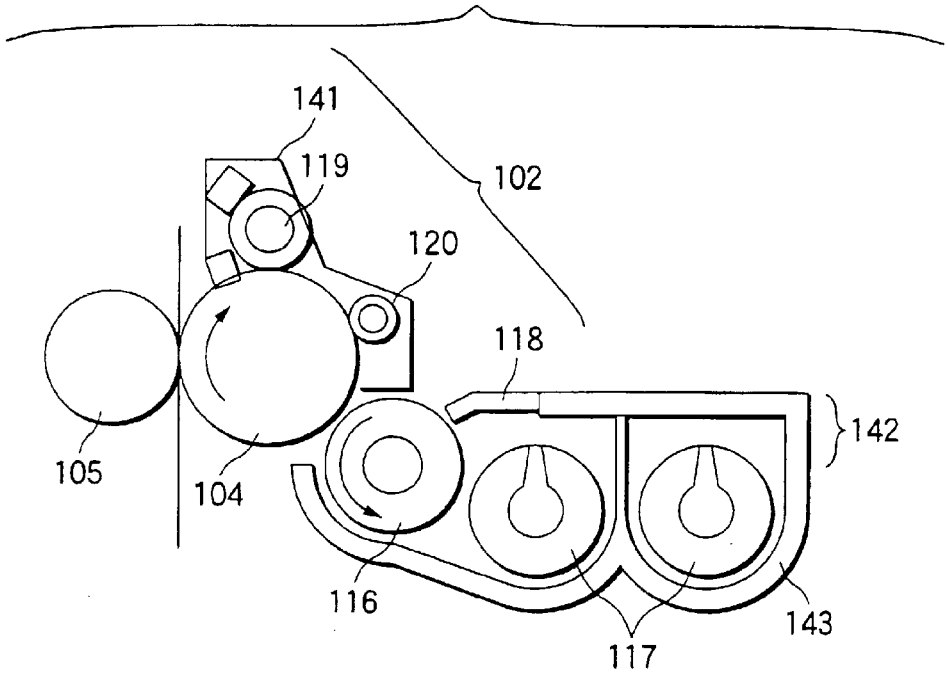
FIG. 12 is a schematic representation to show details of an image formation unit used in the first embodiment of the invention.

In the embodiment, the image formation units (102*a* to 102*d*) form yellow, magenta, cyan, and black toner images in the order from the upstream side of the paper transport passage 134 and each image formation unit is an assembly of a photoconductor cartridge, a developing device, and a transfer roll. The photoconductor cartridge is a cartridge of a drum-like photoconductor 104, a charging roll 120 for previously charging the photoconductor 104, and a roller cleaner 119 made of an elastic substance sponge roll for removing the remaining toner on the photoconductor 104 in one piece particularly as shown in FIG. 12. It is considered that the appropriate diameter of the photoconductor 104 is 30 mm to 16 mm from the viewpoints of shortening the image formation unit spacing, the paper transportability, and the transferability. Each developing device (142*a* to 142*d*) for developing an electrostatic latent image exposed to light and formed in the optical unit 140 on the charged photoconductor 104 in the corresponding color toner is attached to the apparatus side.

In the embodiment, the developing device 142 is disposed below the photoconductor 104 and has a developing housing 143 extending in a lateral direction for storing a developer (mono component developer or dual-component developer) containing predetermined color toner. A pair of developer agitating members 117 is disposed in the developing housing 143 and a developing roll 116 is disposed in an opening part of the developing housing 143 opposed to the photoconductor 104 and a developer layer thickness regulating member 118 for regulating the layer thickness of the developer on the developing roll 116 is provided. On the other hand, the cleaner is disposed above the photoconductor 104 and is shaped like a roller of conductive urethane foam. While the cleaner is given a voltage of the opposite polarity to that of toner and has a peripheral speed difference from the photoconductor 104, the cleaner rotates in contact with the photoconductor 104 in the same rotation direction as the photoconductor 104 for scraping the remaining toner off the photoconductor 104.

Figure 11A:
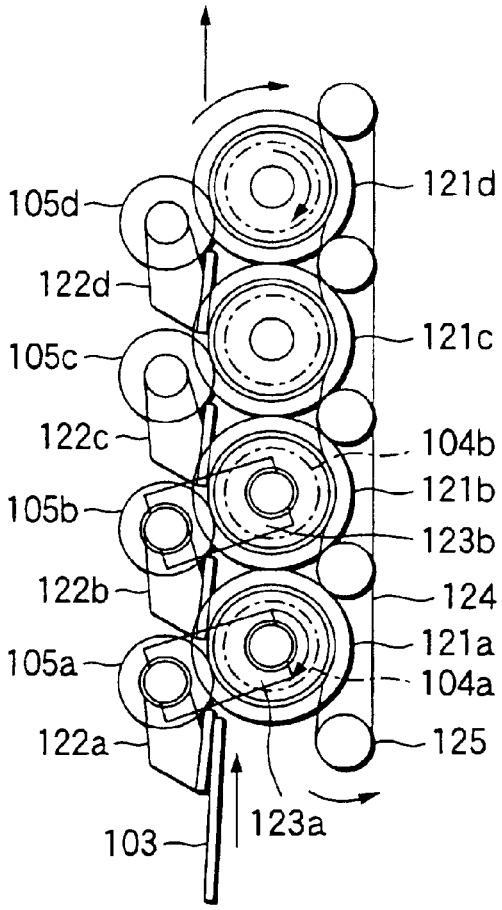
FIGS. 11A and 11B are schematic representations to show details of a paper transport system used in the first embodiment of the invention.
Figure 11B:
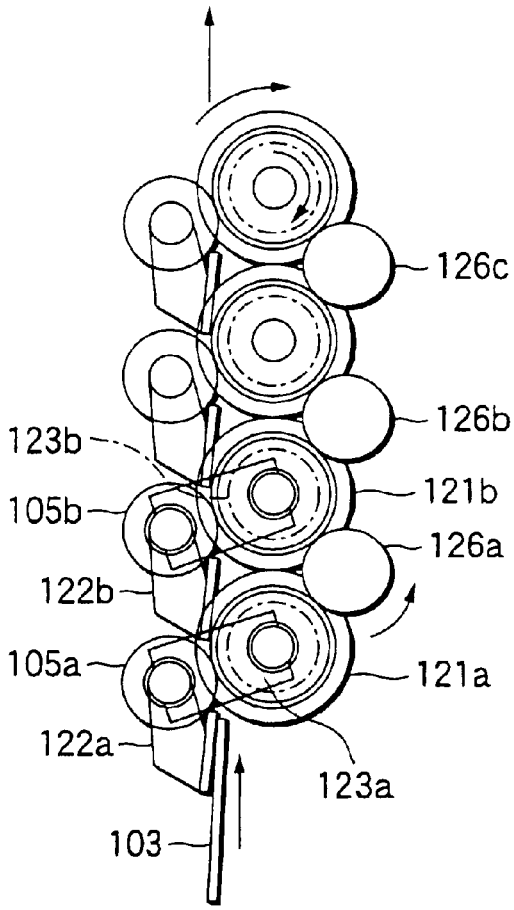

Particularly, in the embodiment, the developing housing 143 for storing a developer is extended in the lateral direction, whereby the developer storage space is provided, so that the up and down direction dimension of each image formation unit 102 is set short. As shown in FIGS. 11A and 11B, to set the photoconductors 104 of the image formation units 102 to the same peripheral speed, ball bearings each with the outer periphery fixed and the inner periphery sliding or plain bearings (121*a* to 121*d*) made of resin material of PPS, etc., resistant to temperature change and abrasion support the outer peripheral surface of the photoconductor 104 for rotation, thereby suppressing run-out of each photoconductor 104 and the same face of a single endless belt 124 is pressed against the outer peripheral surface of a non-print area of each photoconductor 104 and the outer periphery of the photoconductor 104 is frictionally driven by a drive member 125 and drive transmission is performed by geared flanges (not shown) each attached to the end part of each photoconductor 104 and idle gears (126*a* to 126*c*), thereby setting the photoconductors 104 to the same peripheral speed.

Further, in the embodiment, as shown in FIGS. 11A and 11B, a transfer roll 105 is provided separately from the photoconductor cartridge 141 and to place the photoconductors (104*a* to 104*d*) in the same abutment state, the transfer roll 105 is supported for rotation by transfer positioning members. (123*a* to 123*b*) with the rotation center of the corresponding photoconductor 104 as the positioning reference, abuts the photoconductor 104 of the photoconductor cartridge 141, and is rotated in synchronization with the photoconductor 104 through a drive transmission system (not shown). A predetermined transfer electric field is applied to the transfer roll 105 for giving a transfer force to the transfer roll 105 side to the toner image on the photoconductor 104.

In the embodiment, as shown in FIG. 10, the paper feed cassette 127 is provided with a feed roll 115 for sending paper 103 at a predetermined timing and a pair of a registration roll 106 and a pinch roll 107 as a nip transport member on the entrance side is placed on the paper transport passage 134 positioned between the feed roll 115 and the transfer part of the upstream image formation unit 102*a* and an optical paper passage sensor (not shown) is disposed downstream of the paper transport passage 134. In the embodiment, the paper passage sensor (not shown) detects the tip of paper and, for example, the electrostatic latent image write timing in the optical unit 140 of each image formation unit (102*a* to 102*d*) is controlled based on the detection timing of the paper tip.

Further, a fuser 108 as a nip transport member on the exit side is placed on the transfer material transport passage 101 positioned downstream from the downstream image formation unit 102*d*. The fuser 108 has a heating roll 110 and a pressurizing roll 109. Further, an ejection roll 130 for ejecting paper is placed downstream from the fuser 108 and ejected paper is stored in a storage tray 139 formed on the top of housing. Assuming that the transport speed of the nip transport member of the registration roll 106 and the pinch roll 107 on the entrance side is V1, that the transport speed of the fuser nip transport member on the exit side is V3, and that the peripheral speed of each photoconductor (104*a* to 104*d*) is V2, the relation $V1 \geqq V2 \geqq V3$ is provided, whereby slack in paper is produced on the nip upstream side of each photoconductor (104*a* to 104*d*) and each transfer roll (105*a* to 105*d*) and on the fuser nip transport upstream side on the exit side, and the effect of transport unevenness caused by nip transport on the entrance side and the exit side to paper in the transfer part of the transfer roll 105 and the photoconductor 104 can be ignored.

Further, in the embodiment, as shown in FIGS. 11A and 11B, paper guides (122*a* to 122*d*) for regulating the move path of paper are disposed before the image formation units (102*a* to 102*d*). The paper guides (122*a* to 122*d*) disposed before the image formation units (102*a* to 102*d*) are supported integrally on the transfer rolls (105*a* to 105*d*), are placed so that the paper entry angles and positions on the photoconductors (104*a* to 104*d*) conforming to transfer roll (105*a* to 105*d*) positioning become the same, and are adjusted so that they extend toward the direction in which the back of paper containing the tip of the paper transferred and transported always comes in contact with the faces of the paper guides (122*a* to 122*d*), that the paper moves toward the nip area between the photoconductor (104*a* to 104*d*) and the transfer roll (105*a* to 105*d*) while coming in contact with, and that the paper tip collides with the photoconductor (104*a* to 104*d*) before the nip area.

Next, the operation of the color image formation apparatus according to the embodiment will be discussed. Paper 103 in the paper feed cassette 127 is delivered by the feed roll 115 in response to an output signal from a personal computer, etc., (not shown) and then the tip of the paper 103 arrives at the nip part of the registration roll 106 and the pinch roll 107 on the entrance side. Then, the paper is nipped and transported in the pair of the registration roll 106 and the pinch roll 107 on the entrance side and enters the transfer parts of the image formation units (102*a* to 102*d*) on the paper transport passage in order. At this time, as for the paper transport speed, the nip transport speed V1 of the pair of the registration roll 106 and the pinch roll 107 on the entrance side and the photoconductor (104*a* to 104*d*) speed V2 involve the relation $V1 \geqq V2$ and thus slack in the paper is produced between the upstream image formation unit 102*a* and the pair of the registration roll 106 and the pinch roll 107 on the entrance side. Thus, the effect of the transport force of the nip transport part of the pair of the registration roll 106 and the pinch roll 107 on the entrance side can be ignored on the paper entering the transfer part of the upstream image formation unit 102*a* and the transfer roll 105*a*. Further, the passage speed of the paper in the transfer part of each image formation unit (102*a* to 102*d*) is held constant according to the configuration described above. Moreover, the transfer part spacing of each image formation unit (102*a* to 102*d*) is set sufficiently short (about 30 mm) relative to the paper and thus the tip proximity of the paper entering the transfer part of each image formation unit (102*a* to 102*d*) is held in the pair of the registration roll 106 and the pinch roll 107 on the entrance side or the transfer nip part (nip part between the photoconductor 104 and the transfer roll 105) of the image formation units (102*a* to 102*c*) on the front side. Because of the free end length for allowing sufficient firmness of even thin paper to be expected, the tip position of the paper entering the transfer part of each image formation unit (102*a* to 102*d*) becomes stable. Thus, the paper entry timing in the transfer part of each image formation unit (102*a* to 102*d*) is held constant, so that the transfer position shift of each color toner image is eliminated and color shift and color unevenness of the color image are eliminated.

When the tip of the paper arrives at the fuser 108 and is nipped, because of the relation $V2 \geqq V3$ where V3 is the transport speed of the fuser nip transport member and V2 is the peripheral speed of each photoconductor (104*a* to 104*d*), slack is produced in the paper between the fuser 108 and the last image formation unit 102*d*, and the paper transport force of the fuser nip transport member has no effect on the paper in the transfer nip part of each image formation unit (102*a* to 102*d*). Thus, the passage speed of the paper in the transfer part of each image formation unit (102*a* to 102*d*) is always held constant. After this, when the paper has passed through the fuser 108, the paper on which an unfixed toner image is fixed is ejected through the paper ejection roll 130 to the storage tray 139. In such an operation process, it has been recognized that a color image with no color shift, no color unevenness is provided.

Figure 13:
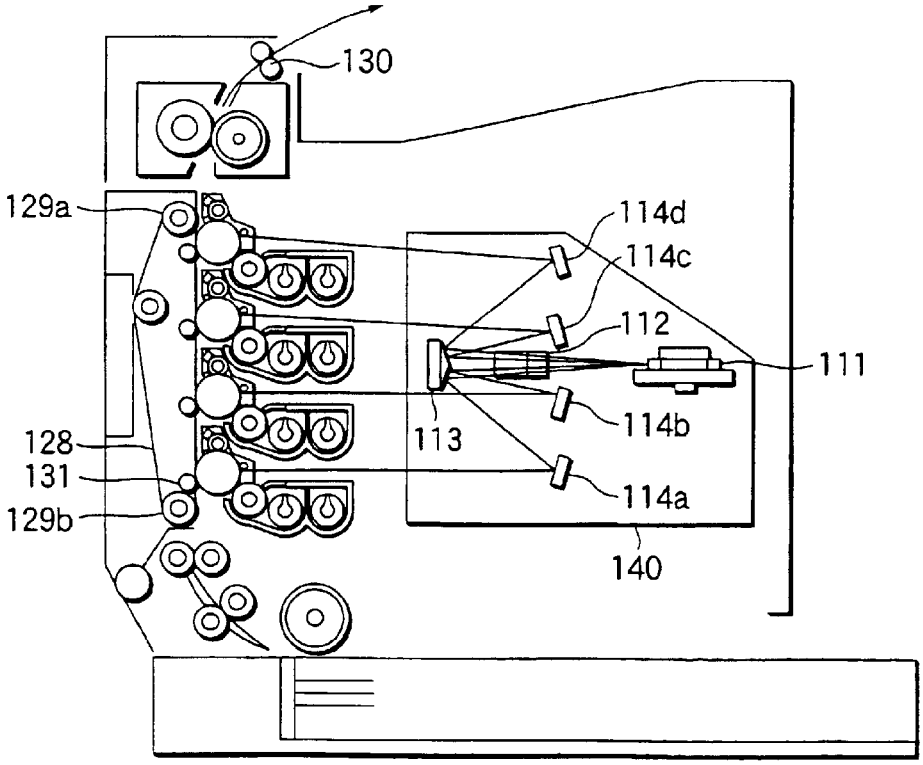
FIG. 13 is a schematic representation to show a different configuration of the image formation apparatus according to the first embodiment of the invention.

Particularly, in the embodiment, the paper transport passage is placed vertically and the image formation units (102*a* to 102*d*) are arranged longitudinally, so that the up and down direction dimension of the housing is set short and moreover the paper feed cassette 127 is disposed below the image formation units (102*a* to 102*d*) and thus the need for providing the installation space as the paper feed cassette 127 protrudes to the outside is eliminated, so that the apparatus can be easily compacted. That is, it is made possible to adjust the image formation position of each color laser beam as desired with a single optical unit from the configuration wherein four single-color optical units are placed in portrait orientation. Thus, if the image formation units (102*a* to 102*d*) are arranged longitudinally at four stages, the up and down direction dimension is not voluminous unnecessarily. As shown in FIG. 13, the transfer material hold transport member is not limited to the transfer roll 105 and may be a transport belt 128. In this case, as the transfer member, it is not indispensable to particularly give a transport force to a transfer material and thus the transfer member is not limited to transport and transfer member such as the transfer roll 105 and may be a part such as a metal transfer roll 131 of stainless steel, etc. Since it is not necessary to forcibly set the photoconductors (104*a* to 104*d*) to the same speed, it is not necessary to perform frictional drive with photoconductor outer periphery support bearing or endless belt, but the parts placement space of the transfer parts and the tension roller space (129*a* to 129*b*) of the transport belt become necessary and the up and down dimension of the apparatus becomes a little large as compared with the transfer roll transport technique.

However, the image formation unit (102*a* to 102*d*) spacing can be shortened, so that it is made possible to reduce the peripheral length of the transport belt 128 to a half or less as compared with that in the related art, a walk phenomenon in which when the paper transport belt 128 moves, it meanders in the width direction can be suppressed, and color shift and color unevenness of the color image can be improved in the orthogonal direction (width direction) to the paper transport direction.

(Embodiment) 4

Figure 14:
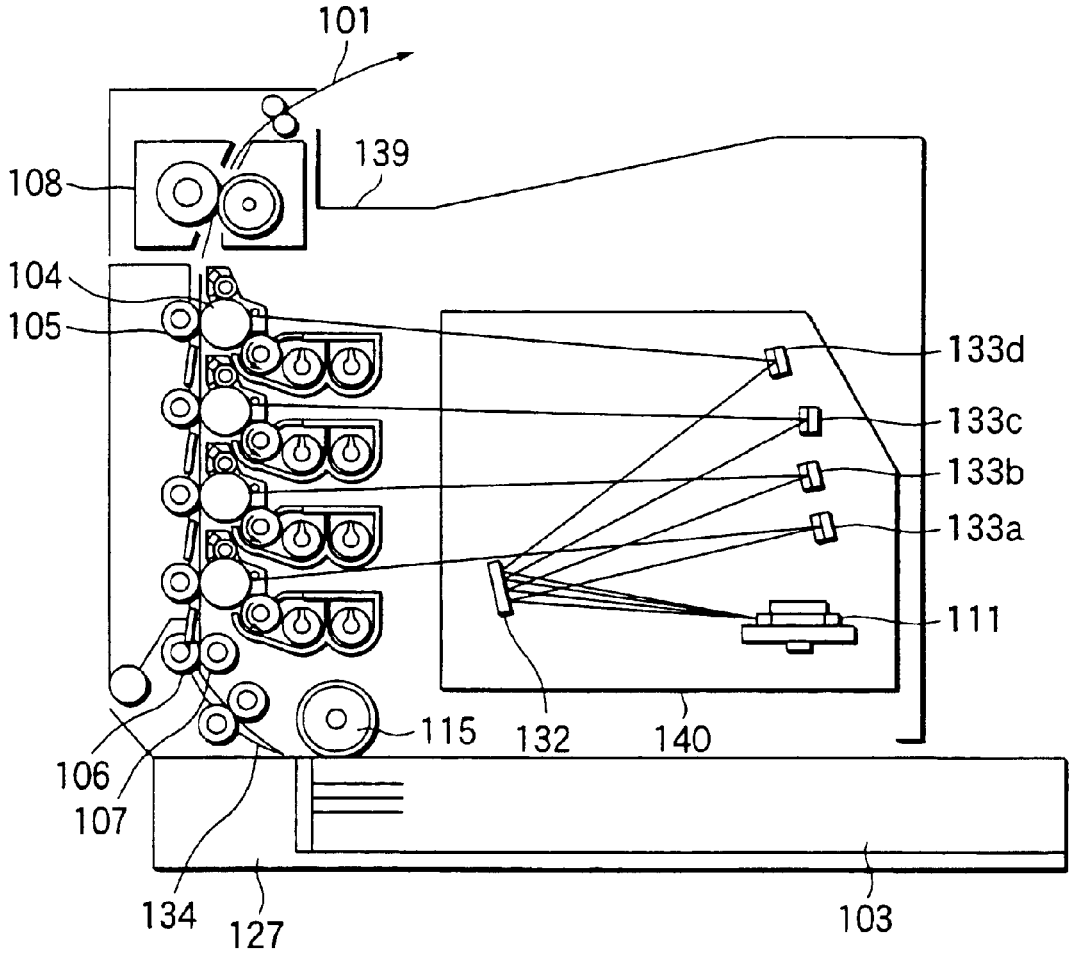
FIG. 14 is a schematic representation to show an outline of an image formation apparatus according to a second embodiment of the invention.
Figure 15:
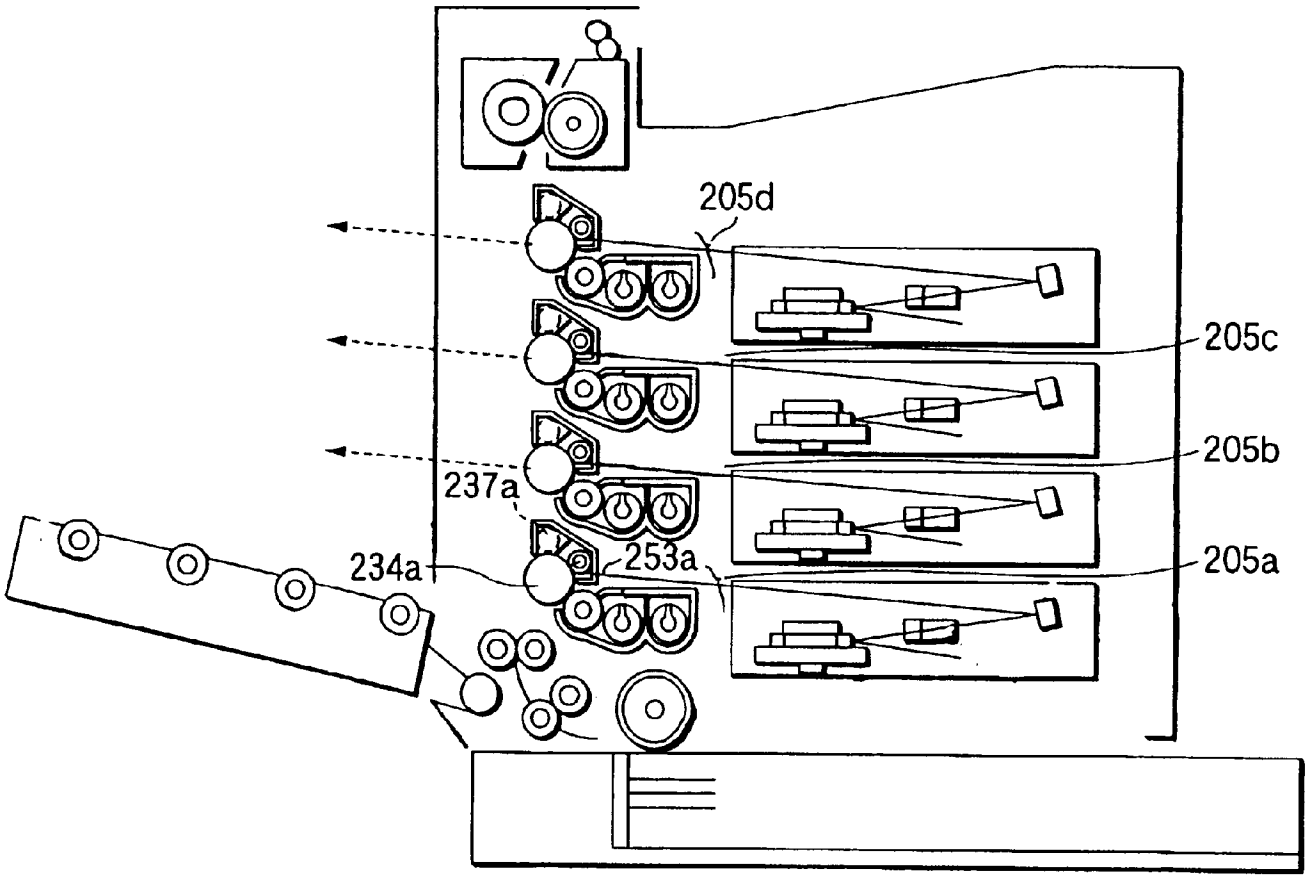
FIG.15 PRIOR ART
FIG. 15 is a schematic representation to show an outline of a conventional image formation apparatus.

FIG. 14 shows a fourth embodiment of a color image formation apparatus of the invention. In the embodiment, the color image formation apparatus has image formation units of four colors roughly like that of the third embodiment (components similar to those of the third embodiment previously described with reference to FIGS. 10 to 13 are denoted by the same reference numerals in FIG. 14 and will not be discussed again in detail) and differs from that of the third embodiment only in optical unit as follows: An optical unit 140 includes an incidence optical member (not shown) having a cabinet for holding color semiconductor lasers integrally and optical elements for giving a different angle to each color laser beam and making the color laser beam incident on a single polygon mirror 111 surface rotating at high speed, a single first reflecting mirror 132 for reflecting the laser beam for each color reflected on the polygon mirror 111 in the opposite direction to the incidence direction, and a plurality of second reflecting mirrors (133*a* to 133*d*) having Fθ and reflection characteristics for forming an image of the laser beam for each color reflected on the first reflecting mirror 132 on the image formation position for each color. According to the configuration, the image formation position spacing for each color can be adjusted as desired by changing the characteristics and the installation angles of the first reflecting mirror 132 and the second reflecting mirrors (133*a* to 133*d*). It is understood from optical design that the appropriate image formation position spacing for each color is 25 mm to 35 mm from the viewpoints of ensuring accuracy on working on the reflecting mirrors and ensuring the reliability of the characteristics roughly as in the third embodiment. The second reflecting mirrors (133*a* to 133*d*) may be formed in one piece.

Next, the operation of the color image formation apparatus according to the fourth embodiment is similar to that according to the third embodiment and therefore will not be discussed again.

Preferably, in the third and fourth embodiments, as shown in FIGS. 10 and 14, the reflection direction angle difference between the reflected laser beams each for each color reflected on the second reflecting mirror of the optical unit 140 is set within 10 degrees. According to this configuration, the developing device configurations of the image formation units are made the same, so that it becomes easy to combine the developing characteristics of the image formation units, and there liability of the image quality is also enhanced.

The optical unit of the third embodiment and fourth embodiment of the invention may be applied to the first or second embodiment.

According to the invention, the position accuracy of the photoconductor unit and the developing unit is maintained and consequently, good image formation is made possible.

According to the invention, it is made possible to miniaturize the apparatus itself and consequently, the transfer part spacing can be shortened, so that color shift and color unevenness of a color image accompanying transport unevenness of the transfer material can be suppressed.

Further, according to the first embodiment of the invention, the following advantages can be provided:

Although the photoconductor unit and the developing unit are separated, it is made possible to position each unit by a single member of a pair of unit guide and positioning members attached to both sides of the apparatus main unit, so that it becomes easy to ensure the accuracy. Further, the image formation apparatus has the advantage that the rotation center shaft of the photoconductor of the photoconductor unit can be directly positioned and supported.

Particularly, in the layout of a plurality of photoconductor units and a plurality of developing units, each developing unit is placed at a position overlapping the adjacent photoconductor unit in the displacement direction of the developing unit, so that it is made possible to shorten the image formation unit spacing (to 25 mm), the paper transport stability can be provided, and it is made possible to provide a color image with no color shift and no color unevenness.

Further, a removal prevention member is disposed so that the developing unit cannot easily attached to or detached from the apparatus main unit, and only the photoconductor unit can be attached to and detached from the apparatus main unit, so that degradation of the reliability such as mixing a foreign substance in the developing unit or dropping the developing unit can be prevented.

Further, the transfer member is positioned relative to the corresponding photoconductor through transfer member reception part formed in the same member as the image formation unit position member on both sides of the apparatus main unit, so that the state of transfer part entry and detachment of paper can be made uniform and thus it is made possible to provide a color image with no color shift and no color unevenness.

Further, according to the fourth embodiment of the invention, a plurality of photoconductor units are positioned in the apparatus main unit as an integral-type photoconductor unit group supported on a single cabinet, whereby the positioning parts in the apparatus main unit can be reduced to a single part, so that parts management of the apparatus main unit is facilitated and it is made possible to improve the accuracy and simplify the apparatus configuration.

Further, according to another aspect of the invention, the optical unit includes an incidence optical member having a cabinet for holding color semiconductor lasers integrally and optical elements for giving a different angle to each color laser beam and making the color laser beam incident on a single polygon mirror surface, a single image-forming lens having Fθ characteristic through which each color laser beam reflected on a polygon mirror passes through, a first reflecting mirror for reflecting the laser beam after passing through the image-forming lens in the opposite direction to the incidence direction, and a plurality of second reflecting mirrors for forming an image of each laser beam reflected on the first reflecting mirror on the image formation position for each color.

According to the configuration, the image formation position spacing for each color can be adjusted as desired by changing the installation angles of the image-forming lens and the reflecting mirrors.

Thus, the transfer part spacing of each image formation unit can be shortened, so that the transport speed and entry position of the transfer material can be stabilized.

Thus, color shift and color unevenness of a color image accompanying transport unevenness of the transfer material can be suppressed and the apparatus itself can be easily miniaturized without using a transfer material hold transport member such as a transfer material transport belt.

Particularly, in the invention, if the transfer material transport passage is placed roughly vertically and the image formation units are arranged longitudinally, the up and down direction dimension of each image formation unit can be set short and moreover it is made possible to use the lower space of the image formation unit to dispose transfer material supply member, so that the apparatus can be compacted easily.

According to another aspect of the invention, the image formation apparatus differs from that of the third embodiment only in optical unit as follows:

The optical unit includes an incidence optical member having a cabinet for holding color semiconductor lasers integrally and optical elements for giving a different angle to each color laser beam and making the color laser beam incident on a single polygon mirror surface, a single first reflecting mirror for reflecting the laser beam for each color reflected on the polygon mirror in the opposite direction to the incidence direction, and a plurality of second reflecting mirrors having Fθ and reflection characteristics for forming an image of the laser beam for each color reflected on the first reflecting mirror on the image formation position for each color.

According to the configuration, the image formation position spacing for each color can be adjusted as desired by changing the characteristics and the installation angles of the first reflecting mirror and the second reflecting mirrors, and similar advantages to those in the third embodiment can be provided.

Further, according to another aspect of the invention, the reflection direction angle difference between the reflected laser beams each for each color reflected on the second reflecting mirror of the optical unit is set within 10 degrees, whereby the developing device configurations of the image formation units are made the same, so that it becomes easy to combine the developing characteristics of the image formation units, and the reliability of the image quality is also enhanced.

What is claimed is:

1. A color image formation apparatus comprising:

a single optical unit having:

an incidence optical member for giving a different angle to each of a plurality of laser beams to form a color image and making the laser beam incident on a single polygon mirror rotation body;

a single first reflecting mirror for reflecting the laser beam for each color reflected on the polygon mirror rotation body in the opposite direction to the incidence direction; and a single or a plurality of second reflecting mirrors having reflection and FΘ characteristics for forming an image of each reflected laser beam reflected on the first reflecting mirror on an image formation position for each color; and a plurality of image formation units being disposed along a transfer material transport passage placed in a roughly vertical direction, each being disposed at the image formation position for each color where an image is formed by said optical unit.

2. The color image formation apparatus as claimed in claim 1, wherein a reflection direction angle difference between reflected laser beams each for each color reflected on the second reflecting mirror of said optical unit is set within 10 degrees.

3. A color image formation apparatus as claimed in claim 2, wherein said image formation units are provided for cyan, magenta, yellow, and black.

4. A color image formation apparatus as claimed in claim 2, wherein said optical unit holds a semiconductor laser.

5. A color image formation apparatus as claimed in claim 2, wherein a distance between each of the image formation positions is defined in a range from 25 mm to 35 mm.

6. A color image formation apparatus as claimed in claim 1, wherein said image formation units are provided for four colors.

7. A color image formation apparatus as claimed in claim 6, wherein said optical unit holds a semiconductor laser.

8. A color image formation apparatus as claimed in claim 6, wherein a distance between each of the image formation positions is defined in a range from 25 mm to 35 mm.

9. A color image formation apparatus as claimed in claim 1, wherein said optical unit holds a semiconductor laser.

10. A color image formation apparatus as claimed in claim 1, wherein a distance between each of the image formation positions is defined in a range from 25 mm to 35 mm.

* * * * *